US007395930B2

(12) United States Patent
Tauchen

(10) Patent No.: US 7,395,930 B2
(45) Date of Patent: Jul. 8, 2008

(54) TENNIS BAG

(75) Inventor: Lynne Tauchen, Las Vegas, NV (US)

(73) Assignee: Jet Imports Inc., Las Vegas, NV (US)

( * ) Notice: Subject to any disclaimer, the term of this patent is extended or adjusted under 35 U.S.C. 154(b) by 384 days.

(21) Appl. No.: 10/725,741

(22) Filed: Dec. 2, 2003

(65) Prior Publication Data

US 2005/0115848 A1 Jun. 2, 2005

(51) Int. Cl.
*B65D 71/00* (2006.01)

(52) U.S. Cl. ..... 206/579; 206/315.1; 206/315.9; 190/109

(58) Field of Classification Search ..... 206/545, 206/315.1, 315.9, 315.11, 493, 477–482, 206/579; 190/102, 108–110; 224/153, 578, 224/579, 602, 610, 903; 383/38, 110, 111; 150/112

See application file for complete search history.

(56) References Cited

U.S. PATENT DOCUMENTS

| | | | | |
|---|---|---|---|---|
| 2,767,758 | A | 10/1956 | Haynes | |
| 3,346,155 | A | 10/1967 | Oechsle | |
| 3,963,103 | A | 6/1976 | Cowen, III | |
| D246,940 | S | 1/1978 | Sabol | |
| 4,085,873 | A | 4/1978 | Schweitzer | |
| 4,119,127 | A | 10/1978 | Klug | |
| 4,153,092 | A | 5/1979 | Haslam | |
| 4,164,968 | A | 8/1979 | Esposito, Jr. et al. | |
| RE30,138 | E | 11/1979 | Cowen, III | |
| D262,072 | S | 12/1981 | Pfeiffer | |
| D268,712 | S | 4/1983 | Hoberman et al. | |
| D273,534 | S | 4/1984 | Weinreb | |
| 4,506,769 | A | 3/1985 | Franco et al. | |
| D281,119 | S | 10/1985 | Kalkus | |
| D281,290 | S | 11/1985 | Beigel | |
| D284,620 | S | 7/1986 | Calton | |
| D284,715 | S | 7/1986 | Jacober et al. | |
| 4,673,117 | A | 6/1987 | Calton | |
| 4,752,008 | A | 6/1988 | Pratt | |
| 4,773,535 | A * | 9/1988 | Cook | 383/39 |
| 4,805,748 | A | 2/1989 | Gerch | |
| 4,810,102 | A | 3/1989 | Norton | |
| 5,005,679 | A * | 4/1991 | Hjelle | 190/110 |
| D320,692 | S | 10/1991 | Killer | |
| 5,071,126 | A | 12/1991 | Baugh | |
| 5,238,305 | A * | 8/1993 | Feller | 383/39 |
| D340,351 | S | 10/1993 | Wrath | |
| D354,851 | S | 1/1995 | Smith et al. | |
| 5,413,199 | A * | 5/1995 | Clement | 206/315.1 |
| 5,415,332 | A | 5/1995 | Kliot | |
| 5,431,265 | A * | 7/1995 | Yoo | 190/109 |
| 5,431,317 | A | 7/1995 | Kliot | |
| 5,450,991 | A * | 9/1995 | Neading | 224/578 |
| 5,509,279 | A | 4/1996 | Brown et al. | |
| 5,529,229 | A | 6/1996 | Fier | |

(Continued)

OTHER PUBLICATIONS

Flyer for Jet Bag 2002/2003 Collection, circa Jan. 2003.

(Continued)

*Primary Examiner*—Luan K Bui
(74) *Attorney, Agent, or Firm*—Baker & Daniels LLP

(57) ABSTRACT

A bag including a racquet compartment coupled to an accessory compartment.

20 Claims, 23 Drawing Sheets

U.S. PATENT DOCUMENTS

| | | | | | |
|---|---|---|---|---|---|
| 5,558,259 | A | | 9/1996 | Izzo | |
| D375,403 | S | | 11/1996 | Melk | |
| D378,165 | S | | 2/1997 | Tucker | |
| 5,655,695 | A | * | 8/1997 | Anderson et al. | 206/315.1 |
| 5,839,577 | A | | 11/1998 | Friedler | |
| 5,881,875 | A | | 3/1999 | Beurekjian | |
| 5,950,894 | A | | 9/1999 | Haber | |
| 5,975,293 | A | | 11/1999 | Fowler | |
| 5,979,727 | A | | 11/1999 | Steurer | |
| 6,000,103 | A | * | 12/1999 | Paice et al. | 206/38 |
| 6,009,995 | A | | 1/2000 | Speck | |
| 6,029,830 | A | | 2/2000 | Manookian | |
| 6,053,340 | A | | 4/2000 | Cameron | |
| D425,698 | S | | 5/2000 | Paul et al. | |
| 6,138,881 | A | | 10/2000 | Paul et al. | |
| 6,168,060 | B1 | | 1/2001 | Mayers | |
| 6,182,878 | B1 | | 2/2001 | Racca | |
| 6,328,192 | B1 | | 12/2001 | Sundara et al. | |
| 6,336,577 | B1 | | 1/2002 | Harris et al. | |
| D455,009 | S | | 4/2002 | Thayer | |
| 6,367,674 | B1 | | 4/2002 | Tabor | |
| D458,749 | S | | 6/2002 | Bruni et al. | |
| 6,427,886 | B1 | | 8/2002 | Essex | |
| 6,434,032 | B1 | * | 8/2002 | Romano | 363/146 |
| 6,460,746 | B1 | | 10/2002 | Amram | |
| D471,353 | S | | 3/2003 | Ho | |
| 6,530,507 | B2 | | 3/2003 | Oh | |
| 6,595,358 | B1 | | 7/2003 | Speck | |
| 6,619,447 | B1 | * | 9/2003 | Garcia et al. | 190/110 |
| 6,619,519 | B1 | | 9/2003 | Nix et al. | |
| 2002/0185395 | A1 | * | 12/2002 | Lindamood | 190/102 |

OTHER PUBLICATIONS

Photos of Tennis Bag on sale prior to Dec. 2, 2002, 12 pages.

* cited by examiner

TENNIS BAG

BACKGROUND AND SUMMARY OF THE INVENTION

The present invention relates to article carriers and, more particularly, to a bag configured to carry racquets.

In an illustrative embodiment of the present invention, a tennis bag includes a front wall, a rear wall positioned in spaced relation to the front wall in defining a longitudinal center axis, and opposing first and second side walls connecting the front wall and the rear wall. A bottom wall is coupled to the first and second side walls, the front wall, and the rear wall. An accessory compartment is defined by the front wall and the rear wall, the accessory compartment including an upper center portion, a first lower corner portion laterally offset from the center upper portion, and a second lower corner portion laterally offset from the center upper portion. An accessory compartment closing member is configured to close an opening to the accessory compartment between the front wall and the rear wall. The accessory compartment closing member extends within portions of both the first and second side walls. A racquet panel is coupled to the front wall, and a racquet compartment is defined by the front wall and the racquet panel. A racquet compartment closing member is coupled to the racquet panel and is configured to close at least a portion of an opening between the front wall and the racquet panel.

A carrying strap includes an upper end and a lower end, the upper end being coupled to the upper center portion of the accessory compartment proximate the longitudinal center axis. A releasable fastening member is coupled to the lower end of the strap. A first mating fastening member is coupled proximate the lower corner portion of the accessory compartment and is laterally offset from the longitudinal center axis. A second mating fastening member is coupled proximate the second lower corner portion of the accessory compartment and is positioned in spaced relation to the first mating fastening member and laterally offset from the longitudinal center axis. The releasable fastening member is configured to be selectively coupled to one of the first and second mating fastening members.

In a further illustrative embodiment of the present invention, a tennis bag includes a front wall, a rear wall positioned in spaced relation to the front wall, and an accessory compartment defined by the front wall and the rear wall. An accessory compartment closing member is positioned adjacent to the upper portion and extends from the first side to the second side of the accessory compartment. A racquet panel is coupled to the front wall, the racquet panel including opposing arcuate first and second side edges, a lower edge coupled to the first and second side edges and an upper edge positioned above the lower edge and coupled to the first and second side edges. The upper edge defines an upper opening between the racquet panel and the front wall. The racquet compartment is defined by the front wall and the racquet panel, and has a generally truncated egg-shaped cross section defined by the first and second side edges, the lower edge, and the upper edge of the racquet panel and configured to conform to the shape of a racquet head.

In yet another illustrative embodiment of the present invention, a tennis bag comprises a front wall, a racquet panel coupled to the front wall and including first and second opposing side edges, a lower edge coupled to the first and second side edges, and an upper edge positioned above the lower edge and coupled to the first and second side edges. The upper edge defines an upper opening between the racquet panel and the front wall. A racquet compartment is defined intermediate the front wall and the racquet panel. A center partition is received within the racquet compartment and defines first and second racquet pockets, each configured to receive the head of a tennis racquet. A first racquet pocket closing member is coupled to the racquet panel and is configured to secure one of the first side edge and the second side edge of the racquet panel relative to the front wall. A second racquet pocket closing member is coupled to the racquet panel in spaced relation to the first racquet pocket closing member, the second racquet pocket closing member configured to secure one of the first side edge and the second side edge of the racquet panel relative to the front wall.

In a further illustrative embodiment of the present invention, a bag comprises a front wall, a rear wall positioned in spaced relation to the front wall, an accessory compartment defined intermediate the front wall and the rear wall, and a racquet compartment coupled to at least one of the rear wall and the front wall. An accessory compartment closing member is configured to close an opening to the accessory compartment between the front wall and the rear wall. The accessory compartment closing member extends from a first end upwardly within the second side wall to within the first side wall. A ball storage pocket is received within the accessory compartment and is coupled to at least one of the rear wall and the front wall, the ball storage compartment configured to receive a canister of tennis balls and being angled upwardly from horizontal.

In another illustrative embodiment of the present invention, a bag comprises a support wall, a pocket coupled to the support wall, and a connector having a first end and a second end, the first end being coupled within the pocket. A fence hook is coupled to the second end of the connector.

In yet another illustrative embodiment of the present invention, a tennis bag includes a front wall, a rear wall positioned in spaced relation to the front wall, and a accessory compartment defined intermediate the front wall and the rear wall. A racquet compartment is coupled to at least one of the front wall and the rear wall. A carrying strap is coupled to the accessory compartment, and a mobile phone holder is releasably coupled to the carrying strap.

In a further illustrative embodiment of the present invention, a tennis bag includes an accessory compartment including an upper portion and a lower portion, and a racquet compartment coupled to the accessory compartment. The racquet compartment includes an interior defined by opposing first and second sides, a bottom, and a top. At least one of the first and second sides of the racquet compartment includes an opening to the interior. A closing member is coupled to the at least one first and second sides of the racquet compartment and is configured to selectively close the opening. The first and second sides, the bottom and the top of the racquet compartment define a generally truncated egg-shaped cross-section configured to conform to the shape of a racquet head. A carrying strap extends from the upper portion of the accessory compartment to the lower portion of the accessory compartment.

In a further illustrative embodiment of the present invention, a bag comprises a storage compartment having upper and lower portions, a carrying strap having a first end and a second end, the first end coupled to the upper portion of the storage compartment and the second end coupled to the lower portion of the storage compartment. The carrying strap includes a first support portion, a padded portion, and a plurality of loops coupling the padded portion to the support portion. A carrying handle is coupled proximate the upper portion of the storage compartment and includes a use mode of operation in which the carrying handle extends above the upper portion of the storage compartment, and a storage mode of operation in which the carrying handle is secured intermediate the padded portion and at least one of the loops.

In yet another illustrative embodiment of the present invention, a bag is configured to store a racquet having a head, a throat coupled to the head, and a handle coupled to the throat. The bag includes an accessory compartment, and racquet compartment coupled to the accessory compartment. The racquet compartment includes a top, a bottom, opposing first and second sides, a first wall, a second coupled to the first wall, and an opening defined at the top between the first wall and the second wall. A releasable securing member is positioned at the top of the racquet compartment and is configured to releasably secure the first wall to the second wall. The releasable securing member surrounds the throat of the racquet such that the racquet is secured thereby.

In a further illustrative embodiment of the present invention, a bag is configured to carry a racquet including a head, a handle, and a throat connecting the handle to the head. The bag includes a front wall, a racquet panel coupled to the front wall, and a racquet compartment defined intermediate the front wall and the racquet panel. The racquet compartment includes a top, a bottom, opposing first and second sides, and is configured to retain the head of the racquet. The top of the racquet compartment includes an opening configured to receive the throat of the racquet. A retaining strap extends proximate the top of the racquet compartment intermediate the front wall and the racquet panel. A releasable securing member operably couples to the retaining strap and is configured to selectively couple the retaining strap to the front wall and the racquet panel. The retaining strap is configured to pass through an opening proximate the throat of the racquet to retain the racquet handle in a desired position.

In a further illustrative embodiment of the present invention, a convertible bag includes a front wall, a rear wall positioned in spaced relation to the front wall, and a storage compartment defined intermediate the front wall and the rear wall. A convertible pocket is coupled to the rear wall and includes an interior and an opening in communication with the interior. A retaining member is configured to be removably received within the interior of the convertible pocket by passing though the opening. A first end of a strap is coupled to the retaining member, while a releasable fastening member is coupled to a second end of the carrying strap. A mating fastening member is coupled to the rear wall and is configured to releasably couple to the releasable fastening member thereby coupling the second end of the strap to the rear wall.

In another illustrative embodiment of the present invention, a convertible tennis bag includes a front wall, a rear wall positioned in spaced relation to the front wall and including upper and lower ends, and an accessory compartment defined intermediate the front wall and the rear wall. A racquet panel is coupled to the front wall, and a racquet compartment is defined intermediate the front wall and the racquet panel. A first carrying strap assembly includes a sling strap having an upper end and a lower end, the upper end being configured to be releasably coupled proximate the upper end of the rear wall. A releasable fastening member is coupled to the lower end of the sling strap.

A second carrying strap assembly includes a first backpack strap and a second backpack strap, each backpack strap having an upper and a lower end, the upper end of the first backpack strap being coupled to the upper end of the second backpack strap, wherein the upper end of the first backpack strap and the upper end of the second backpack strap are configured to be releasably coupled proximate the upper end of the rear wall. A first releasable fastening member is coupled to the lower end of the first backpack strap, and a second releasable fastening member is coupled to the lower end of the second backpack strap. A first mating fastening member is coupled proximate the lower end of the rear wall and is configured to releasably couple with one of the releasable fastening members. A second mating fastening member is coupled proximate the lower end of the rear wall in spaced relation to the first mating fastening member and is configured to releasably couple with one of the releasable fastening members. The first carrying strap assembly is interchangeable with the second carrying strap assembly, the first carrying strap assembly configured for use in a one strap sling mode of operation and the second carrying strap assembly configured for use in a two strap backpack mode of operation.

In a further illustrative embodiment of the present invention, a tennis bag includes an accessory compartment, a racquet compartment positioned in spaced relation to the accessory compartment, and a cooler compartment positioned in spaced relation to the racquet compartment, the cooler compartment including an insulated lining.

In a further illustrative embodiment of the present invention, a tennis bag includes an accessory compartment including an open top, and a racquet compartment coupled to the accessory compartment and configured to retain a racquet. A draw string is supported by the accessory compartment and is configured to close the open top of the accessory compartment.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
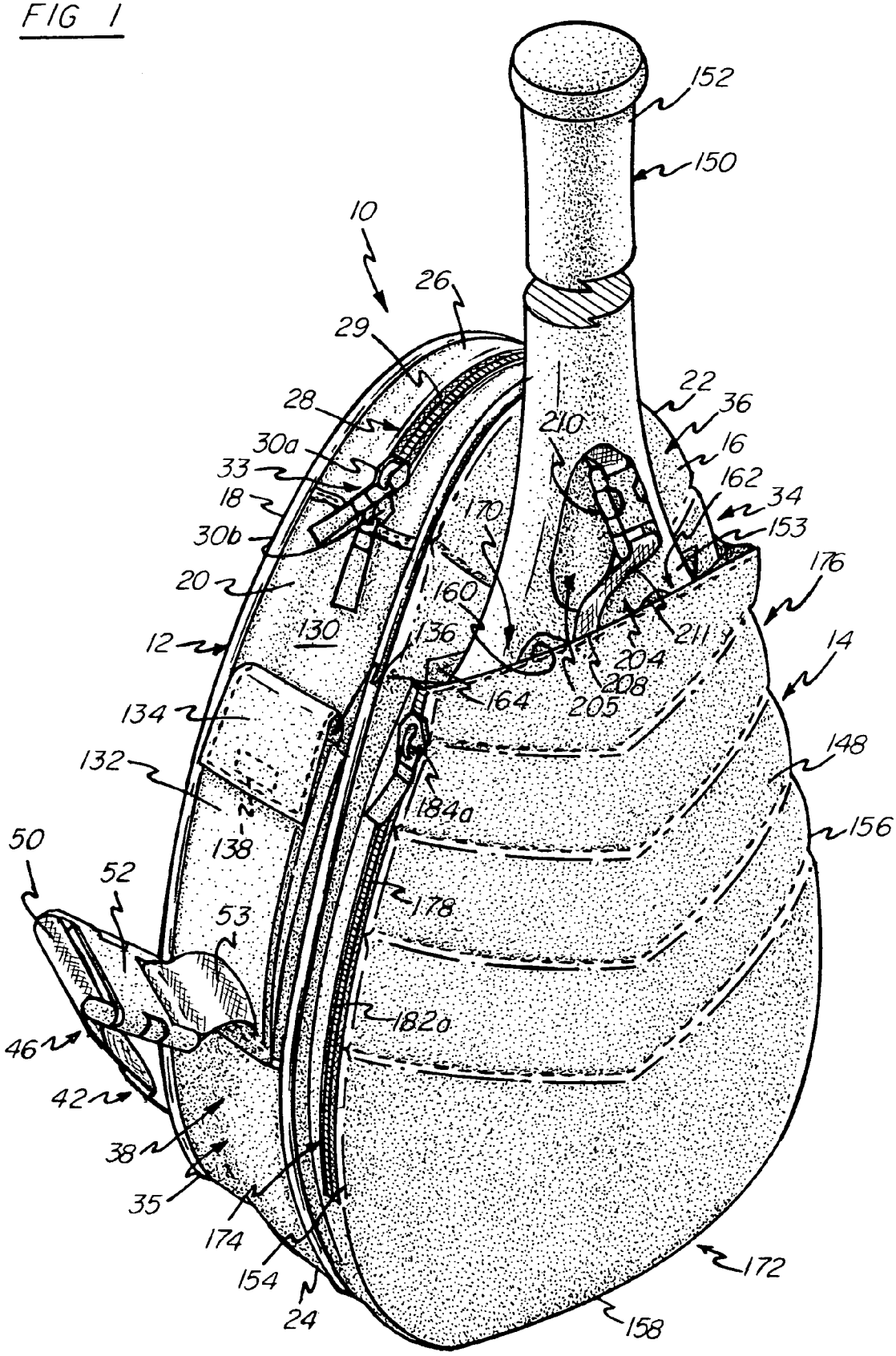
FIG. 1 is a perspective view as seen from the top, front and left side of a tennis bag according to an illustrative embodiment of the present invention showing a tennis racquet secured within a racquet compartment with a retaining strap passing through an opening formed within the throat of the racquet.

Referring now to FIGS. 1-5 of the drawings, a tennis bag 10 according to an illustrative embodiment of the present invention includes a plurality of storage compartments including an accessory compartment 12 and a racquet compartment 14. The accessory compartment 12 and the racquet compartment 14 are illustratively formed from a suitable water repellant flexible sheet material, such as a woven fabric comprised of nylon, vinyl, thermoplastics or other flexible durable material. The tennis bag 10 includes a plurality of connected support panels or walls that define the accessory compartment 12 and the racquet compartment 14. More particularly, a first or front wall 16 is connected to a second or rear wall 18 by opposing first and second side walls 20 and 22 and a bottom wall 24. The first and second side walls 20 and 22 are coupled to the bottom wall 24 and, as such, extend continuously around the periphery of the tennis bag 12. The first and second side walls 20 and 22 have an arcuate shape and extend upwardly from the bottom wall 24 to meet at an apex 26.

An accessory compartment closing member, illustratively a conventional two-way zipper 28, is supported within second side wall 22 and a portion of first side wall 20. The zipper 28 includes a zipper track 29 and a pair of zipper slides or pulls 30*a* and 30*b*. A first end 32 of the zipper track 29 is positioned proximate the bottom wall 24. The zipper track 29 extends from the first end 32 upwardly along the second side wall 22 around the apex 26 and downwardly to a second end 33 positioned within the first side wall 20. The accessory compartment 12 includes upper and lower portions 34 and 35. The upper portion 34 includes an upper center portion 36 defined proximate the apex 26. The lower portion 35 includes a first lower corner portion 38 laterally offset from the upper center portion 36, and a second lower corner portion 40 laterally offset from the upper center portion 36 and positioned in spaced relation to the first lower corner portion 38.

Figure 3:
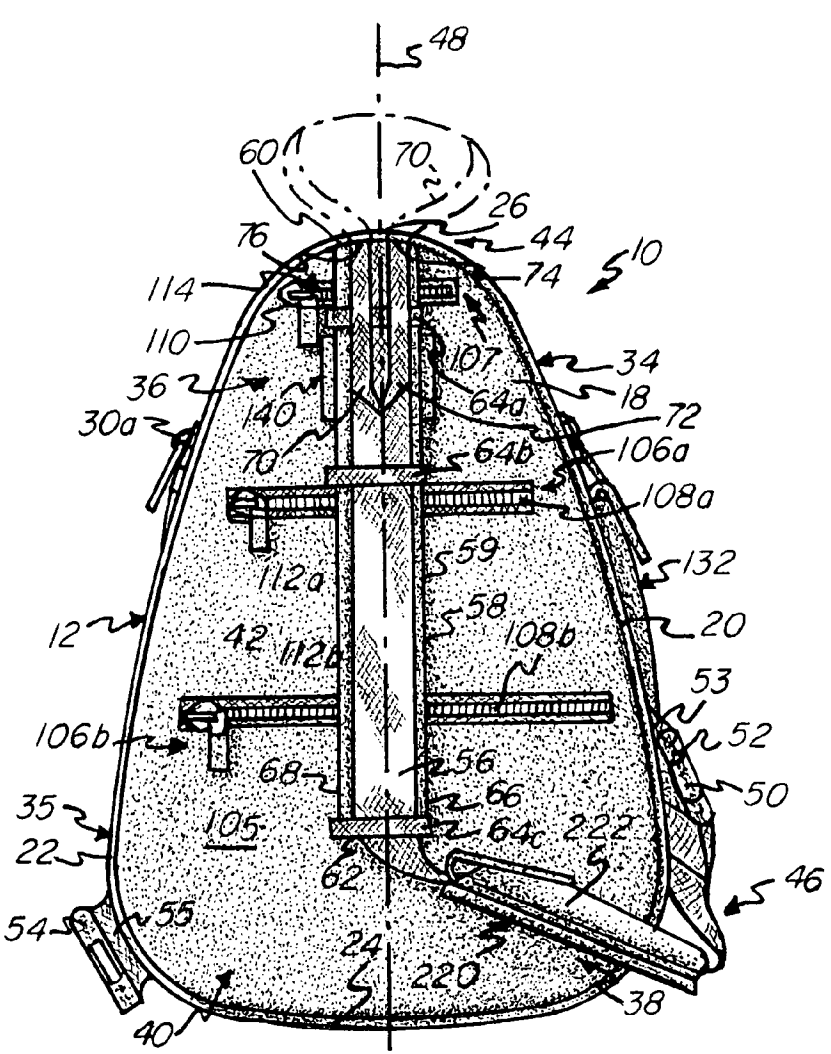
FIG. 3 is a rear elevational view of the tennis bag of FIG. 1.

A carrying strap, illustratively a single sling strap 42, includes a first, or upper end 44 and a second, or lower end 46, and is configured to be supported by a single shoulder of a user. The upper end 44 is coupled to the upper center portion 36 of the accessory compartment 12 proximate the apex 26 (FIG. 3). More particularly, the rear wall 18 includes a longitudinal center axis 48 passing through the apex 26. The upper end 44 of the sling strap 42 is illustratively fixed to the rear wall 18 at the apex 26 and centered about the longitudinal center axis 48. A releasable fastening member 50 is coupled to the lower end 46 of the strap 42.

A first mating fastening member 52 is coupled proximate the first lower corner portion 38 of the accessory compartment 12 and is laterally offset from the longitudinal center axis 48. A second mating fastening member 54 is likewise coupled proximate the second lower corner portion 40 of the accessory compartment 12 and is positioned in spaced relation to the first mating fastening member 52. As with the first mating fastening member 52, the second mating fastening member 54 is laterally offset from the longitudinal center axis 48. In the illustrative embodiment, a strap 53 pivotally couples the first mating fastening member 52 to the first side wall 20 proximate the bottom wall 24, while a strap 55 pivotally couples the second mating fastening member 54 to the second side wall 22 proximate the bottom wall 24.

The releasable fastening member 50 and the mating fastening members 52 and 54 illustratively comprise male and female portions, respectively, of a quick connect and release buckle of the type well known in the art. The releasable fastening member 50 is configured to be selectively coupled to either one of the first and second mating members 52 and 54. As such, the lower end 46 of the strap 42 may be positioned at alternate lower corner portions 38 and 40 of the accessory compartment 12 for the comfort and convenience of the user of the tennis bag 10.

The sling strap 42 includes an elongated support portion 56 extending from the releasable fastening member 50 at the second, or lower end 46 to the first, or upper end 44. A padded portion 58 is coupled to the support portion 56 and extends from the upper end 44 downwardly approximate two-thirds of the distance to the lower end 46. The padded portion 58 illustratively includes a resilient material, such as a polyurethane foam (not shown) received within a fabric cover 59. For aesthetics and durability, the fabric cover 59 illustratively matches the fabric of the rear wall 18. An upper end 60 of the padded portion 58 is illustratively hingedly coupled to the rear wall 18 at the upper center portion 36 of the accessory compartment 12, illustratively through conventional stitching. Further, the upper end 60 of the padded portion 58 is fixed from movement relative to the support portion 62. The lower end 62 of the padded portion is free to move longitudinally along the length of the support portion 56. More particularly, a plurality of retaining loops 64*a*, 64*b*, 64*c* are coupled to opposing side edges 66 and 68 of the padded portion 58, again illustratively through conventional stitching, and slidably receive the support portion 56 of the carrying strap 42.

A carrying handle 70 is illustratively coupled proximate the upper center portion 36 of the accessory compartment 12. The carrying handle 70 comprises a loop 72 of flexible material having opposing first and second ends 74 and 76, respectively. The first and second ends 74 and 76 are fixed, illustratively through conventional stitching proximate the upper end 44 of the sling strap 42 adjacent to the apex 26. The loop carrying handle 70 includes a first, use mode of operation in which the loop 72 extends upwardly above the upper center portion 36 of the accessory compartment 12 (shown in phantom in FIG. 3 and in solid in FIG. 8). The handle 70 further includes a storage mode of operation in which the loop 72 is secured intermediate the padded portion 58 of the sling strap 42 and the upper retaining loop 64*a*. As such, the retaining loop 64*a* retains the carrying handle 70 in a stored position.

Figure 7:
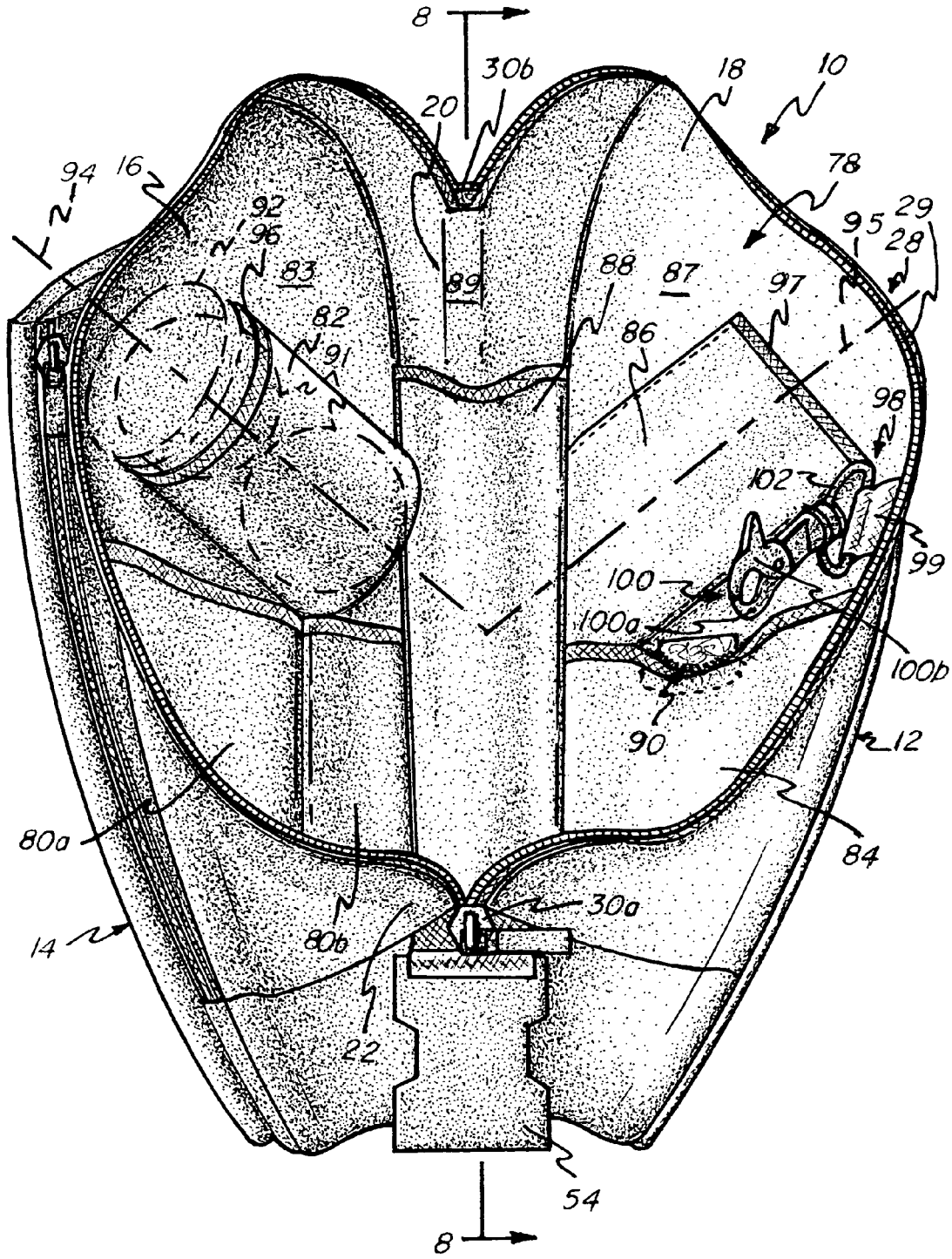
FIG. 7 is a partial perspective view taken from the right side of FIG. 1, showing the interior of the accessory compartment including a plurality of pockets such as a pair of opposing upwardly inclined first and second ball storage pockets, the second ball storage pocket shown for illustrative purposes as receiving a canister of tennis balls.
Figure 8:
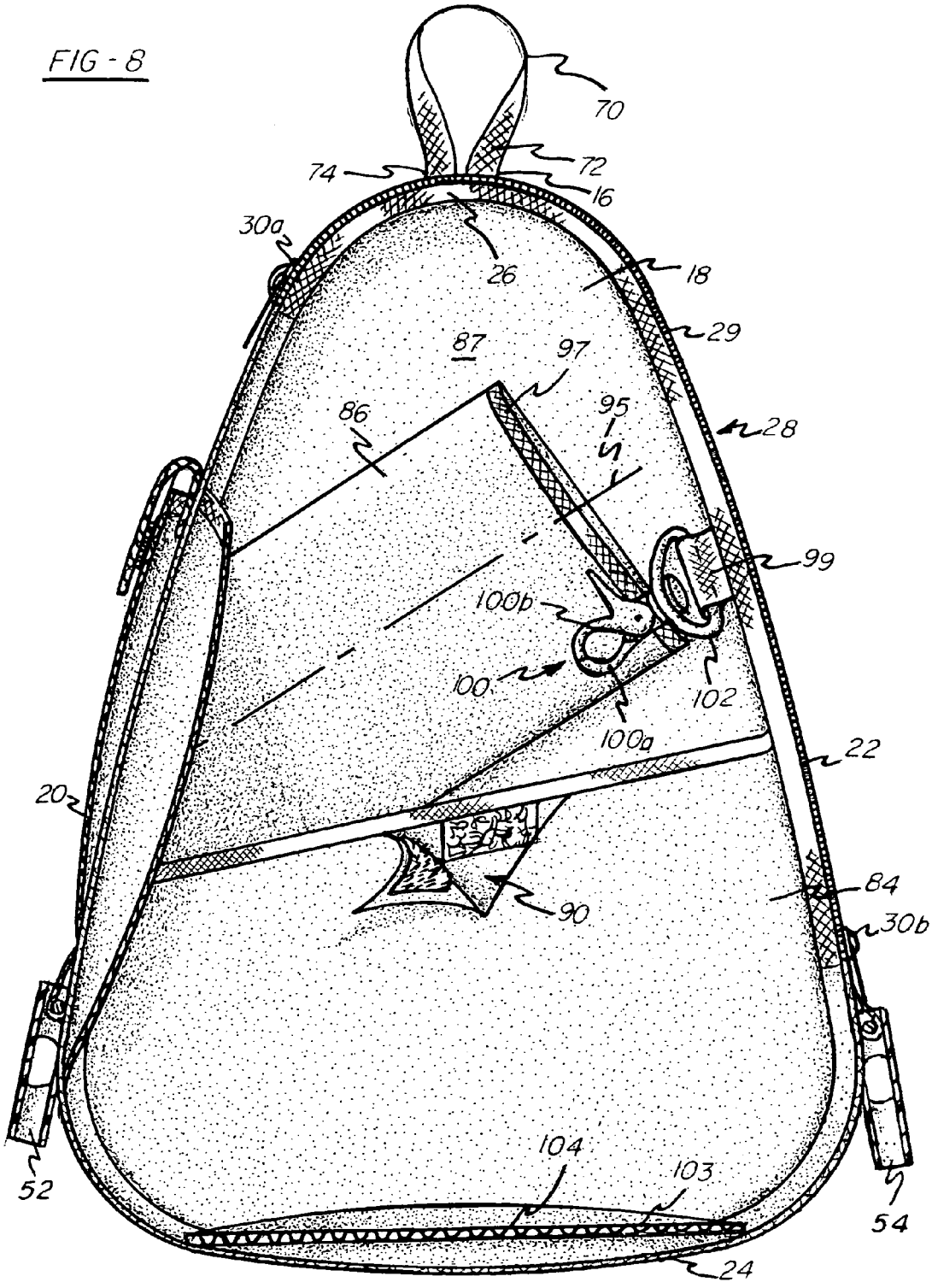
FIG. 8 is an elevational view taken along line 8-8 of FIG. 7, with a partial cut-away of the lower pocket to show the releasable fastener.

With reference now to FIGS. 7 and 8, the front wall 16, rear wall 18, first side wall 20 and second side wall 22 define an interior 78 of the accessory compartment 12. The interior 78 of the accessory compartment 12 may be utilized to carry tennis or other related accessories, including apparel, towels, footwear, tennis balls, wallets, keys, business cards, pens, personal hygiene products, watches, jewelry, glasses, etc. Pockets 80*a*, 80*b* and 82 are supported by an inner surface 83 of the front wall 16, pockets 84 and 86 are supported by an inner surface 87 of the rear wall 18, and a pocket 88 is supported by an inner surface 89 of the first side wall 20. Pockets 80*a*, 80*b*, 84 and 88 are all configured to receive a variety of accessories of the type listed above. For example, pockets 80*a* and 80*b* may be used to hold business cards and pens. Pocket 84 is securable in that an upper opening thereof may be closed and secured through the use of a releasable fastener 90, such as a conventional hook and loop fastener. As such, pocket 84 may be used to hold a wallet or sunglasses.

Pockets 82 and 86 are illustratively configured to hold conventional tennis balls 91. More particularly, the pockets 82 and 86 are configured to receive a conventional canister 92 of tennis balls 91 (illustrated in phantom in FIG. 7). Longitudinal axes 94 and 95 of the pockets 82 and 86, respectively, are angled upwardly relative to horizontal in order to prevent tennis balls 91 from falling outwardly therefrom when the tennis bag 10 is positioned in an upright, standing position. Openings 96 and 97 of the pockets 82 and 86 face the second side wall 22 and accessory compartment closing member 28 in order to provide convenient access thereto.

A key chain holder or clip 98 is coupled to the inner surface 87 of rear wall 18 above pocket 84. The key chain holder 98 is configured to releasably retain a key chain (not shown) or other similar item (such as items including a holding ring). The key chain holder 98 illustratively comprises a conventional swivel spring clip 100 coupled to the rear wall 18 by a strap 99 made of a durable, flexible material. More particularly, the key chain holder 98 includes a first arm 100*a* operably coupled to a spring biased second arm 100*b* which, in turn, are rotatably coupled to a mounting ring 102. The mounting ring 102 is coupled to strap 99, which is positioned adjacent to the second side wall 22 and accessory compartment closing member 28 in order to provide convenient access thereto.

A lower support platform 103 is removably received within the bottom of the accessory compartment 12 in order to facilitate the positioning of the tennis bag 10 in an upright, standing position (FIG. 8). The support platform 103 illustratively comprises a semi-rigid member having a durable water repellant outer surface 104 and is positioned above the bottom wall 24 of the tennis bag 10.

With further reference to FIG. 3, an outside surface 105 of the rear wall 18 includes a plurality of external pockets 106*a*, 106*b* and 107. Each pocket 106*a*, 106*b* and 107 is laterally aligned with respect to the longitudinal center axis 48 of the rear wall 18 and is sized to receive a variety of accessories. The external pockets 106*a*, 106*b* and 107 allow for quick and easy access to items contained therein. A closing member 108*a*, 108*b*, and 110 is coupled to each pocket 106*a*, 106*b* and 107 in order to close respective openings 112*a*, 112*b*, and 114 and prevent items from passing therethrough.

Figure 9:
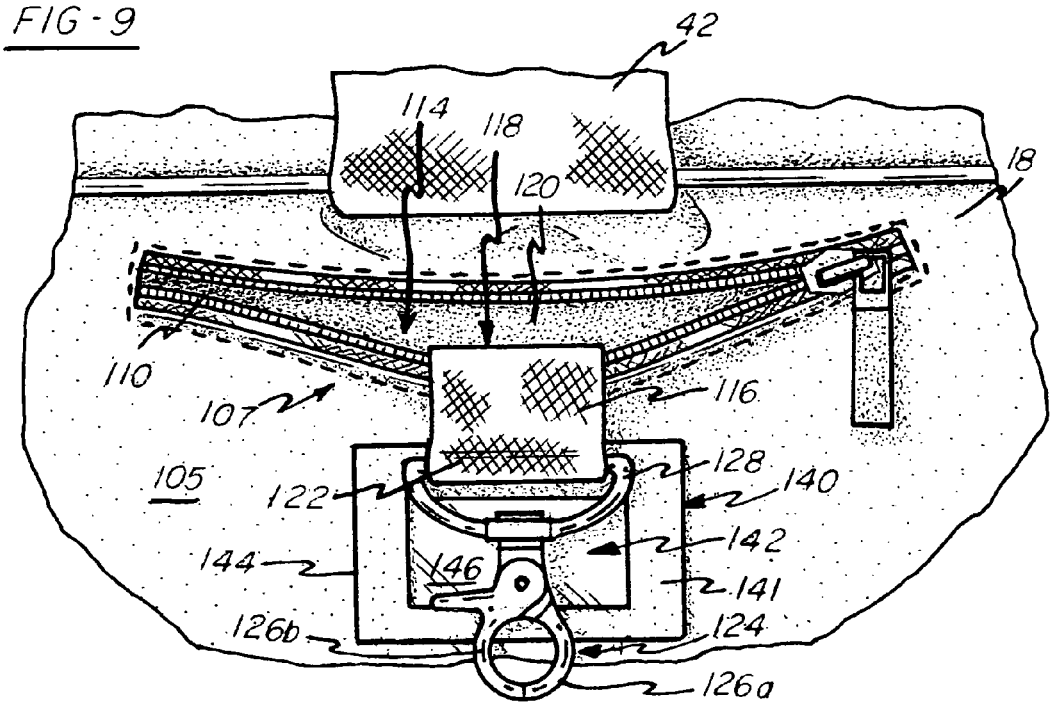
FIG. 9 is a detail perspective view of the top portion of the accessory compartment of the tennis bag of FIG. 1, showing a fence hook and retaining pocket.

Turning now to FIG. 9, a strap connector 116 is received within pocket 107 and includes a first end 118 coupled to an interior 120 of the pocket 107. A second end 122 of the strap connector 116 is coupled to a fence holder or hook 124. The strap connector 116 illustratively comprises a strap made of a durable, flexible material. The fence hook 124 may be of a conventional design and illustratively comprises a swivel spring clip of the type well known in the art. More particularly, the fence hook 124 includes a first arm 126*a* operably coupled to a spring biased second arm 126*b* which, in turn, are rotatably coupled to a mounting ring 128. The mounting ring 128 is coupled to strap connector 116, which is positioned adjacent to the opening 114 of the pocket 107 in order to provide convenient access thereto. It should be appreciated that other hooks and clips may be readily substituted for the swivel spring clip of the illustrative embodiment. The hook 124 is configured to clip onto a fence, or other vertical surface, in order to hang or support the bag 10 therefrom.

As shown in FIG. 1, an outside surface 130 of the first side wall 20 supports an accessory pocket 132. Accessory pocket 132 is configured to receive various items which require quick, and easy accessibility by the user of the bag 10. For example, tennis balls, sunglasses, etc., may be stored within this pocket 132. A flap 134 is hingedly connected to the pocket 132 and may be releasably secured thereto in order to cover an opening 136. More particularly, a releasable securing member 138 is coupled to the flap 134, and illustratively comprises a conventional hook and loop fastener.

Turning now to FIGS. 3 and 9, an identification window 140 is secured to the rear wall 18. The window 140 includes a fabric frame 141 which is secured to the outside surface 105 of the rear wall 18 and defines a receiving pocket 142 having a side opening 144. Items of identification, such as a name card, may be passed through the opening 144 and received within pocket 142 wherein text on the card is visible from the window 140. A transparent pane 146 is illustratively supported by the frame 141 and protects items received within window 140.

With reference to FIGS. 1, 2, and 4-6, a racquet panel 148 is coupled to the front wall 16 thereby forming the racquet compartment 14. The racquet compartment 14 is configured to hold a racquet 150 including a head 151 connected to a handle 152 by a throat 153, in a manner well known in the art. The racquet panel 148 includes opposing arcuate first and second side edges 154 and 156 and an arcuate lower edge 158 coupled to the first and second side edges 154 and 156. A linear upper edge 160 is positioned in spaced relation above the lower edge 158 and is coupled to the first and second side edges 154 and 156. The upper edge 160 defines an upper opening 162 between the racquet panel 148 and the front wall 16. The first and second side edges 154 and 156, the lower edge 158, and the upper edge 160 of the racquet panel 152 define a generally truncated egg-shaped cross-section of the racquet compartment 14. More particularly, the racquet compartment 14 is configured to conform to the shape of the racquet head 151. By conforming to the shape of the racquet head, the side edges 154 and 156 together with the lower edge 158 assist in preventing undesired movement of the racquet within the racquet compartment 14.

Figure 6:
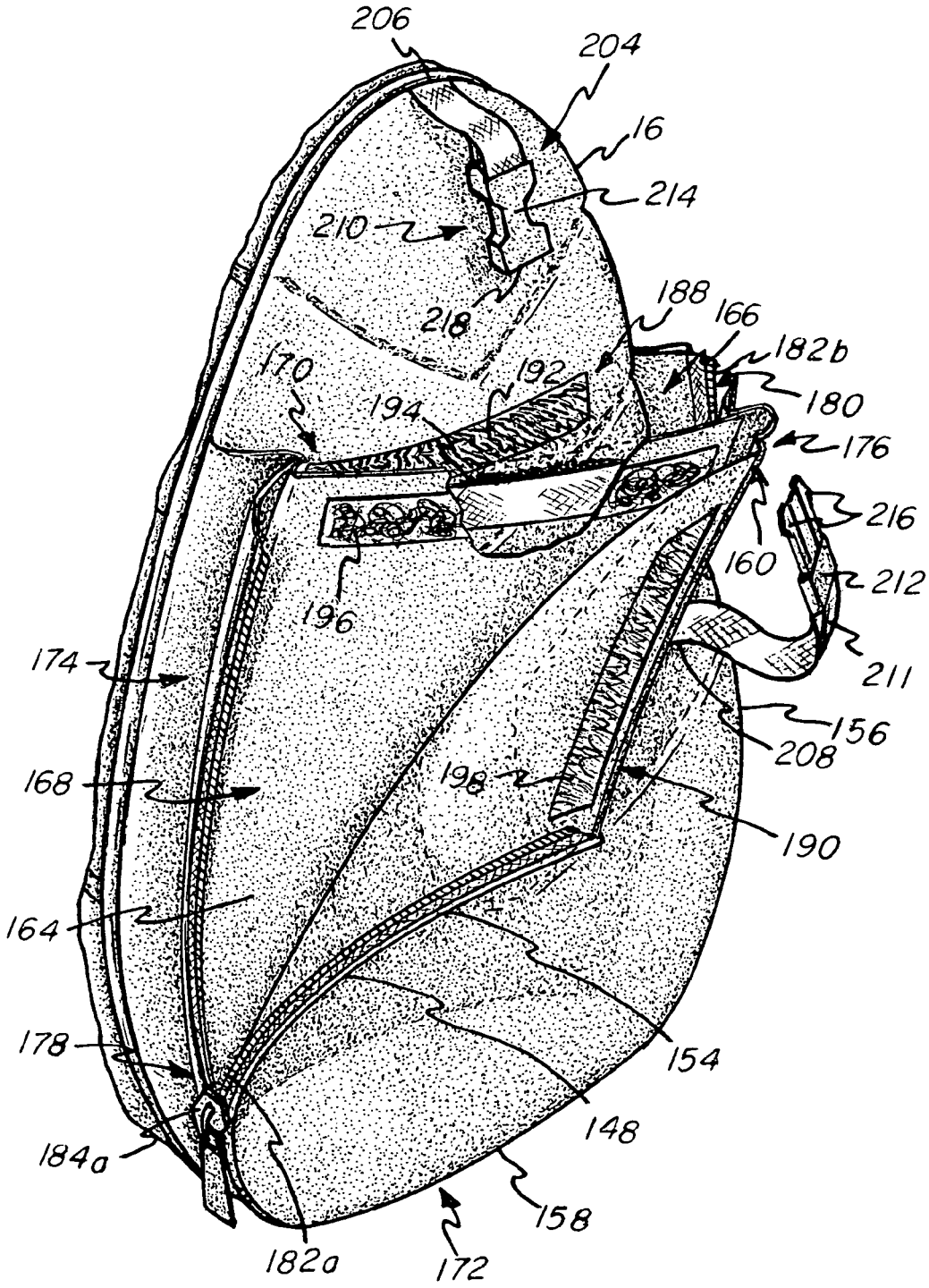
FIG. 6 is a perspective view of the racquet compartment of the tennis bag of FIG. 1, with a partial cut-away, showing the inner and outer racquet pockets separated by a center partition and including a pair of side openings and a pair of top openings for receipt of tennis racquets.

With reference to FIG. 6, a center partition 164 is received within the racquet compartment 14 intermediate the racquet panel 148 and the front wall 16. The center partition 164 divides the racquet compartment 14 into a first, inner racquet pocket 166 and a second, outer racquet pocket 168. Illustratively, each racquet pocket 166 and 168 is configured to receive up to two tennis racquets 150. As such, the tennis bag 10 may conveniently accommodate a total of four tennis racquets 150.

The front wall 16, racquet panel 148, and center partition 164 may all include padding in the form of a resilient material, such as a polyurethane foam (not shown). The padding assists in protecting the racquets 150 received within the racquet compartment 14.

Figure 2:
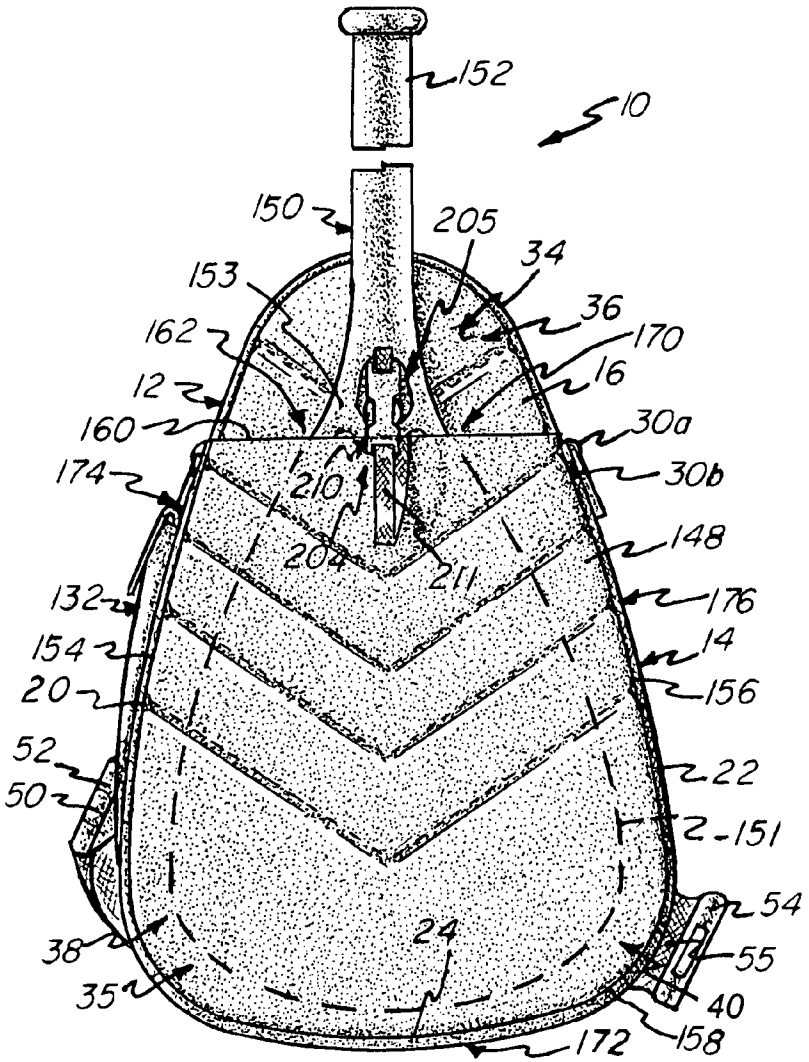
FIG. 2 is a front elevational view of the tennis bag of FIG. 1, again showing a tennis racquet secured within the racquet compartment with the retaining strap passing through the opening formed within the throat of the racquet.
Figure 5:
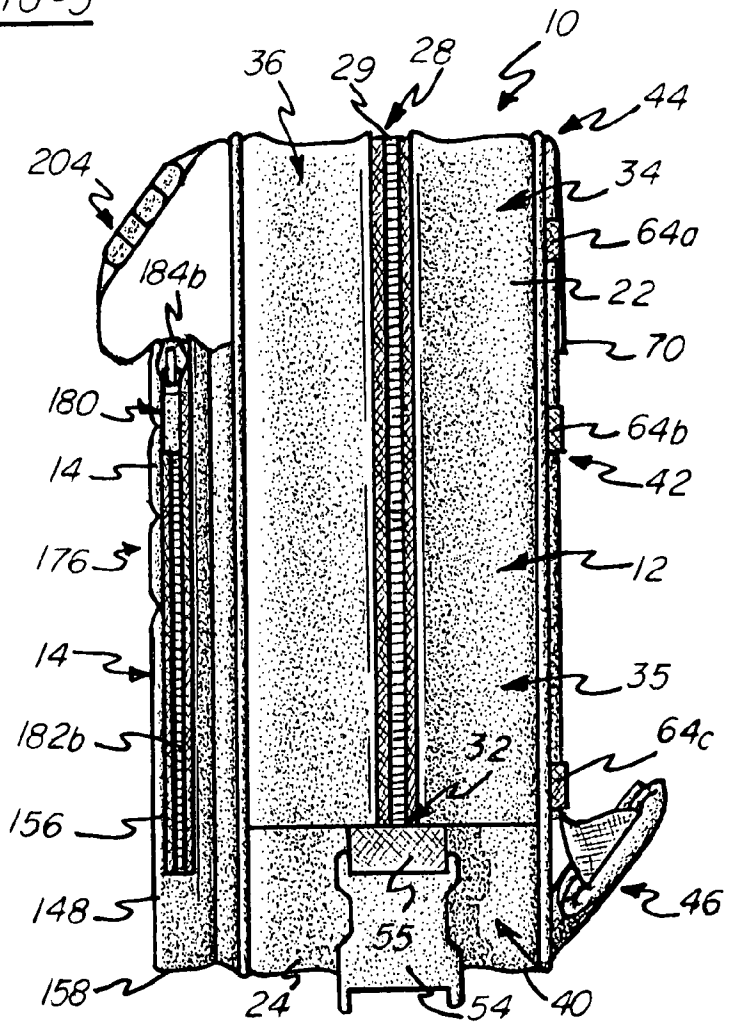
FIG. 5 is a right side elevational view of the tennis bag of FIG. 1, showing a pair of tennis racquets secured within inner and outer racquet pockets of the racquet compartment.
Figure 4:
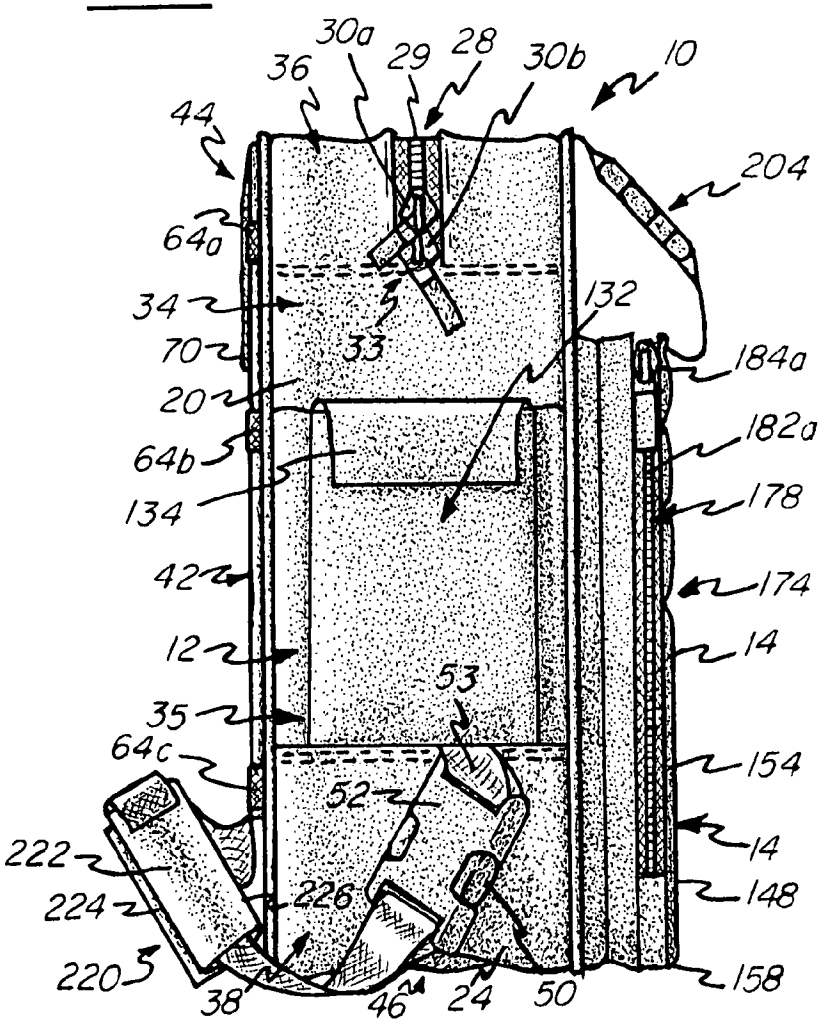
FIG. 4 is a left side elevational view of the tennis bag of FIG. 1, showing a pair of tennis racquets secured within inner and outer racquet pockets of the racquet compartment.

As shown in FIGS. 1, 2, and 6, the racquet compartment 14 includes a top 170, a bottom 172, opposing first and second sides 174 and 176 and opening 162 defined at the top 170. The first side 174 of the racquet compartment 14 is selectively openable for access to the second racquet pocket 168, while the second side 176 of the racquet compartment 14 is selectively openable for access to the first racquet pocket 166. The top 170 of the racquet compartment is likewise selectively openable to gain access to the first and second racquet pockets 166 and 168.

A first racquet pocket closing member 178 is coupled between the racquet panel 148 and the center partition 164. The first racquet pocket closing member 178 is configured to secure the first side edge 154 of the racquet panel 148 relative to the front wall 16, thereby closing the opening at the first side 174 of the racquet compartment 14. More particularly, the first racquet pocket closing member 178 secures the first side edge 154 of the racquet panel 148 to center partition 164. The center partition 164, in turn, is fixed to the front wall 16 adjacent to the first side 174 of the racquet compartment 14.

A second racquet pocket closing member 180 is coupled intermediate the front wall 16 and the center partition 164 which, in turn, is coupled to the racquet panel 148. The second racquet pocket closing member 180 is configured to secure the second side edge 156 of the racquet panel 148 relative to the front wall 16, thereby closing the opening at the second side 176 of the racquet compartment 14. More particularly, the second racquet pocket closing member 180 secures front wall 16 to the center partition 164 adjacent to the second side edge 156 of the racquet panel 148. The center partition 164, in turn, is fixed to the racquet panel 148 adjacent to the second side 176 of the racquet compartment 14.

As may be appreciated, the closing members 178 and 180 by being disposed adjacent to opposing sides 174 and 176 of the racquet panel 148, provide for flexibility in the insertion and removal of racquets 150 from within the first and second racquet pockets 166 and 168. Illustratively, the first and second closing members 178 and 180 each comprise a conventional zipper including a zipper track 182*a*, 182*b*, respectively, extending from adjacent the lower edge 158 of the racquet panel 152 upwardly to the open upper edge 160. A conventional zipper slide or pull 184*a*,184*b* is configured to extend along the each zipper track 182*a*, 182*b*.

With reference to FIG. 6, a first releasable securing member 188 and a second releasable securing member 190 are supported proximate the top 170 of the racquet compartment 14. More particularly, the first releasable securing member 188 is supported intermediate the front wall 16 and the center partition 164, while the second releasable securing member 190 is supported intermediate the center partition 164 and the racquet panel 148. Illustratively, the first and second releasable securing members 188 and 190 each comprise a conventional hook and loop fastener. The first releasable securing member 188 illustratively includes a hook portion 192 coupled to the front wall 16 and a loop portion 194 coupled to the center partition 164, while the second releasable securing member 190 illustratively includes a loop portion 196 coupled to the center partition 164 and a hook portion 198 coupled to the racquet panel 148.

Figure 10:
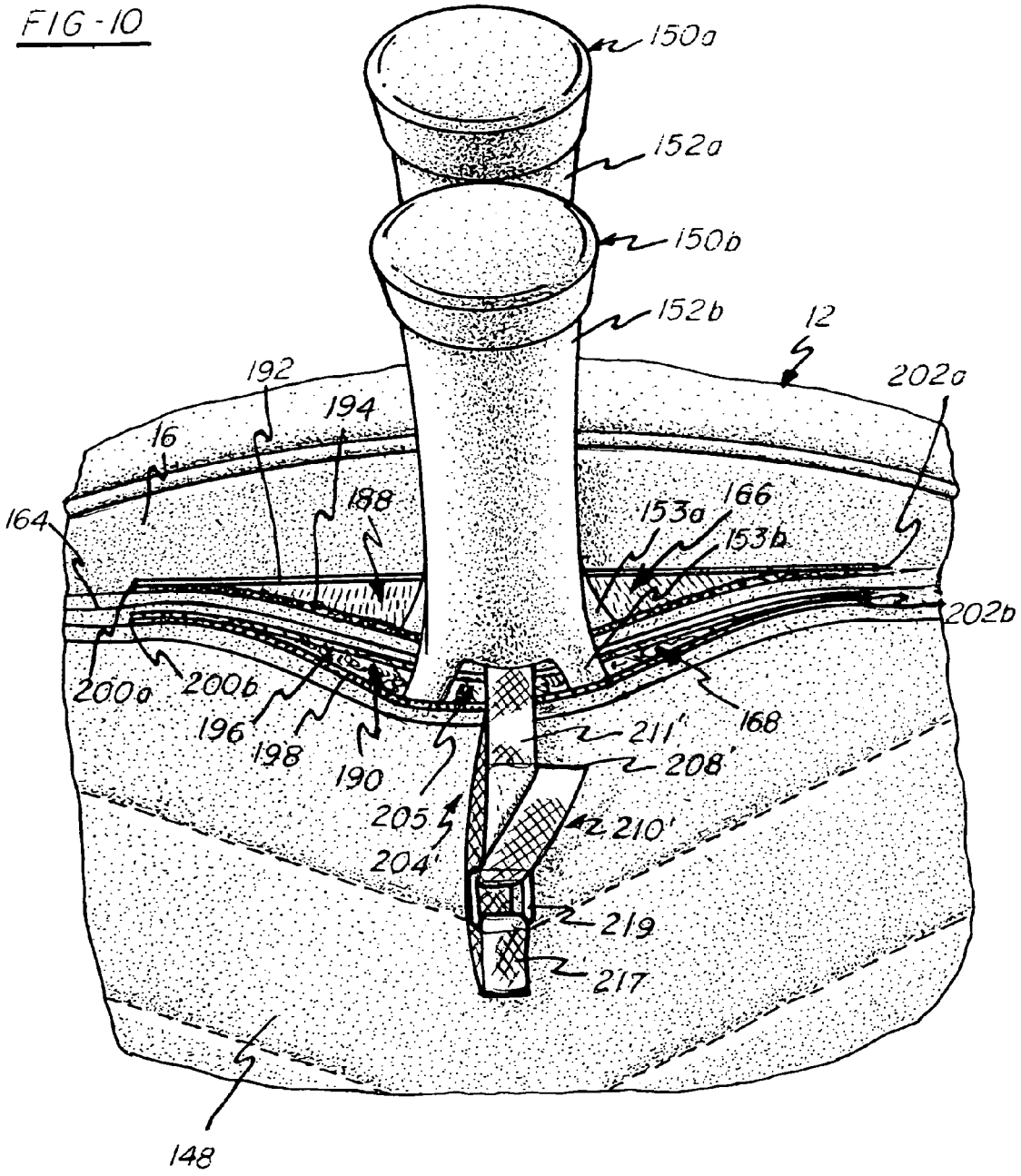
FIG. 10 is a detailed top perspective view of a pair of tennis racquets received within a racquet compartment, each racquet received within a separated racquet pocket.

As shown in FIG. 10, when tennis racquets 150*a*, 150*b* are supported within first and second racquet pockets 166 and 168 of the racquet compartment 14, the first and second releasable securing members 188 and 190 are configured to surround the respective throats 153*a*, 153*b* of the racquets 150*a*, 150*b*, thereby assisting in securing the racquet handles 152*a*, 152*b* in a desired upwardly extending position. More particularly, opposing first and second ends 200*a*, 200*b* and 202*a*, 202*b* of each respective securing member 188 and 190 are positioned on opposite sides of the throats 153*a*, 153*b* of the racquets 150*a*, 150*b*, thereby preventing lateral movement of the respective racquets 150*a*, 150*b* therebetween.

With reference to FIGS. 1, 2, and 6, a retaining strap 204 is positioned intermediate the front wall 16 and the racquet panel 148 and is configured to pass through a predefined opening 205 within the racquet 150, typically formed within the throat 153 of the racquet 150. The retaining strap 204 is configured to further retain the racquet handle 152 in a desired position. The retaining strap 204 includes a first end 206 fixed to the front wall 16 at the upper center portion 36 of the accessory compartment 12, and more particularly, affixed proximate the apex 26. A second end 208 of the retaining strap 204 is fixed proximate the upper edge 160 of the racquet panel 148. A releasable coupling 210 is operably coupled to the retaining strap 204 in order to permit the passage of the strap 204 through the opening of the racquet 150. More particularly, the releasable coupling 210 allows for the receipt of an intermediate portion 211 of the retaining strap 204, between the first and second ends 206 and 208, within the opening 205. The releasable coupling 210 may comprise a conventional quick connect and release assembly including a male portion 212 receivable within a female portion 214. More particularly, the male portion 212 illustratively includes a pair of spring arms 216 which are configured to be lockingly received within an opening 218 of the female portion 214 (FIG. 6), as is known in the art. In alternative embodiments, the releasable coupling 210 may comprise other conventional releasable fasteners.

Figure 11:
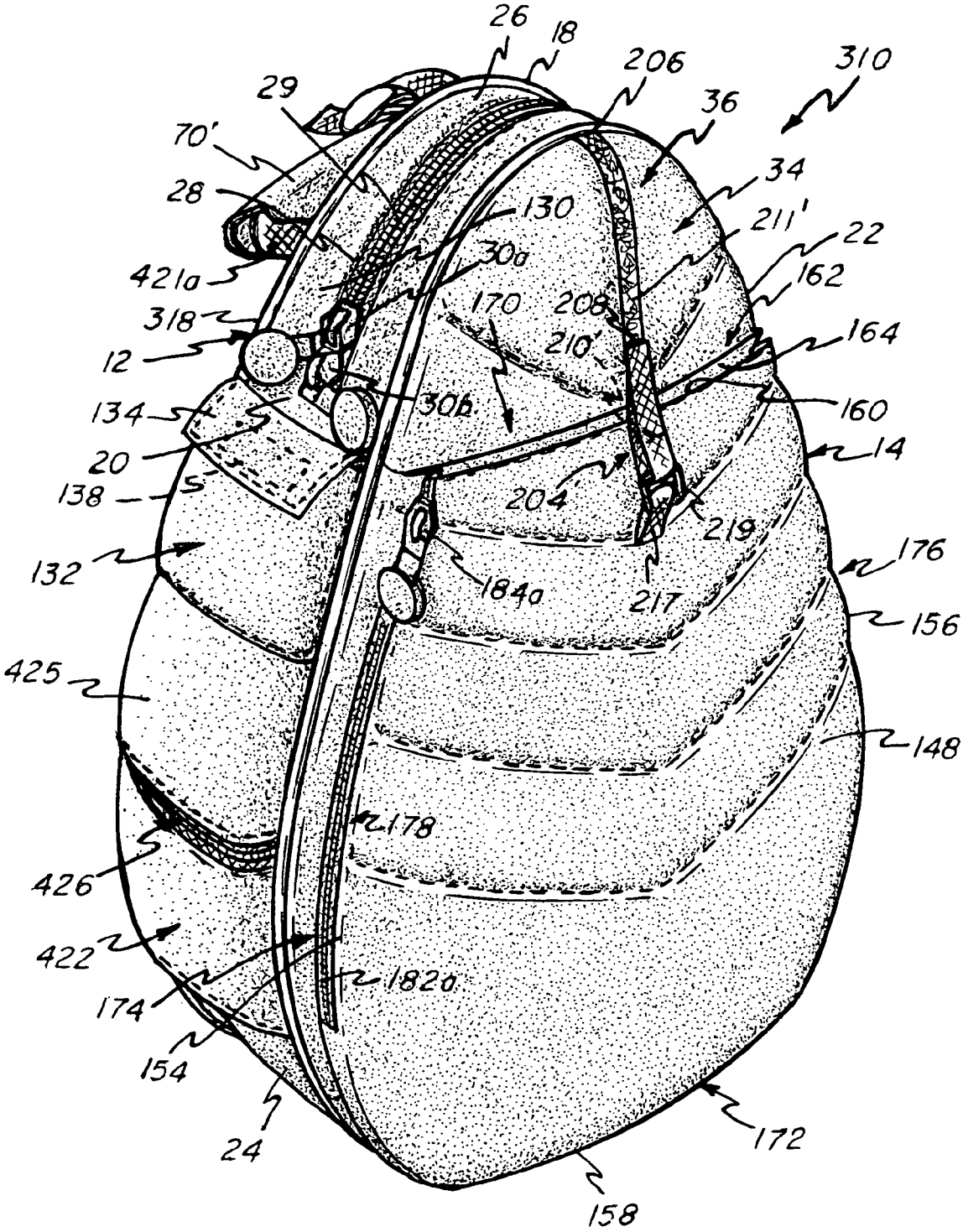
FIG. 11 is a perspective view as seen from the top, front, and left side of a tennis bag according to a further illustrative embodiment of the present invention.

In the illustrative embodiment of FIGS. 10 and 11, the retaining strap 204' includes a first end 206 fixed to the front wall 16 at the upper center portion 36 of the accessory compartment 12 proximate the apex 26, and a free second end 208'. An intermediate portion 211' extends between the first end 206 and the second end 208' and supports a hook and loop fastener 210'. The retaining strap 204' is configured to pass through a ring or loop 219 coupled to the racquet panel 148 by a flexible strap 217, such that the second end 208' wraps over the intermediate portion in an overlapping relationship. The hook and loop fastener 210' secures the second end 208' relative to the first end 206.

Referring again to FIGS. 3 and 4, a cellular or mobile phone holder 220 is releasably coupled to the carrying strap 42. The phone holder 220 includes a phone compartment or case 222 configured to releasably receive a conventional cellular or wireless telephone (not shown). First and second retaining flaps or panels 224 and 226 extend outwardly from the phone case 222 and are releasably coupled together in an overlapping relationship in order to secure the phone holder 220 on the carrying strap 42. Additional details of an illustrative embodiment phone holder 220 are provided herein below in connection with FIGS. 23-25.

Turning now to FIGS. 11-15, a tennis bag 310 according to a further illustrative embodiment of the present invention is shown. The tennis bag 310 includes many of the same features of the earlier described illustrative embodiment tennis bag 10. As such, in the following description like reference numerals will be used to identify like components.

As with the tennis bag 10 described above, the illustrative embodiment tennis bag 310 includes an accessory compartment 12 coupled to a racquet compartment 14. The interior of the accessory compartment 12 of the tennis bag 310 is illustratively identical to that described above with respect to FIGS. 7 and 8. Likewise, the racquet compartment 14 of the illustrative tennis bag 310 is substantially identical to that described above with respect to tennis bag 10.

Figure 13:
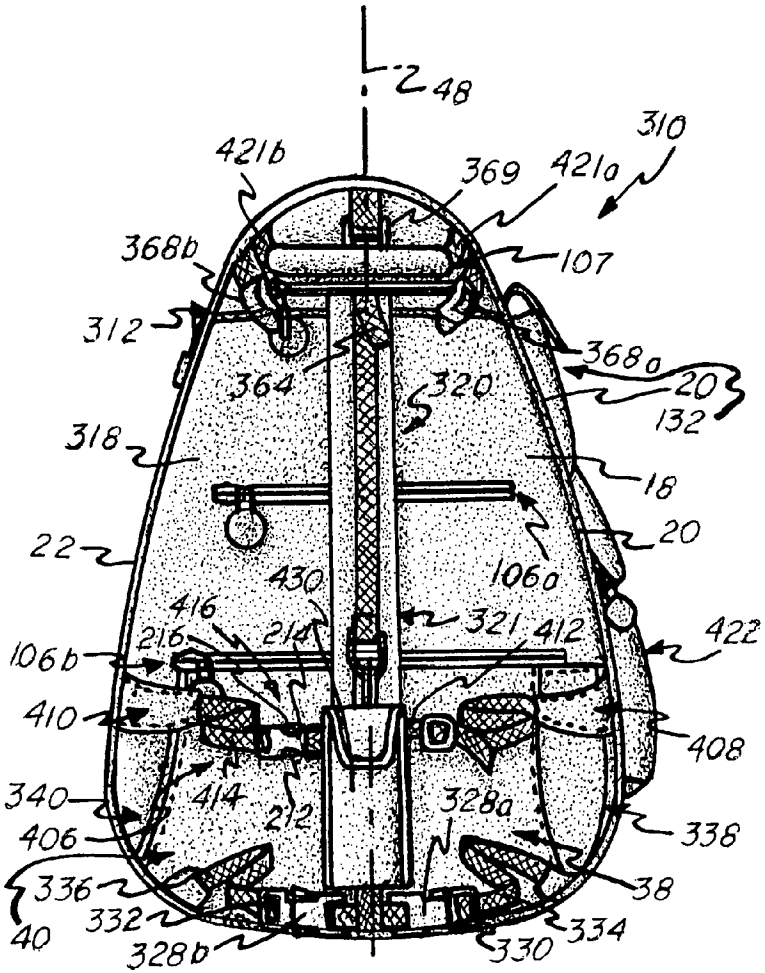
FIG. 13 is a rear elevational view of the tennis bag of FIG. 11.
Figure 12:
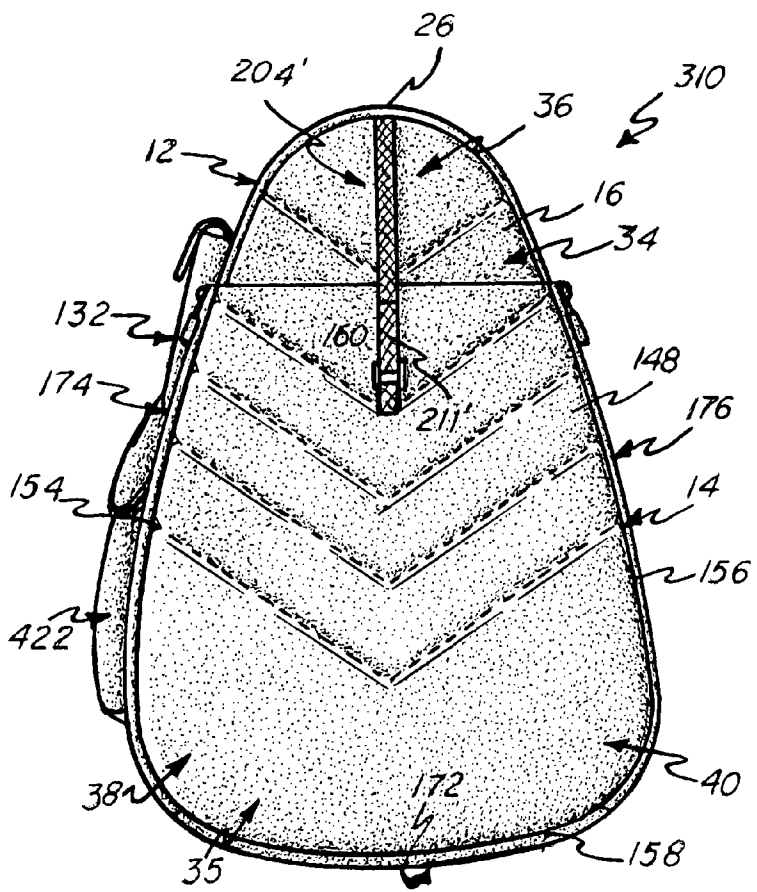
FIG. 12 is a front elevational view of the tennis bag of FIG. 11.
Figure 15:
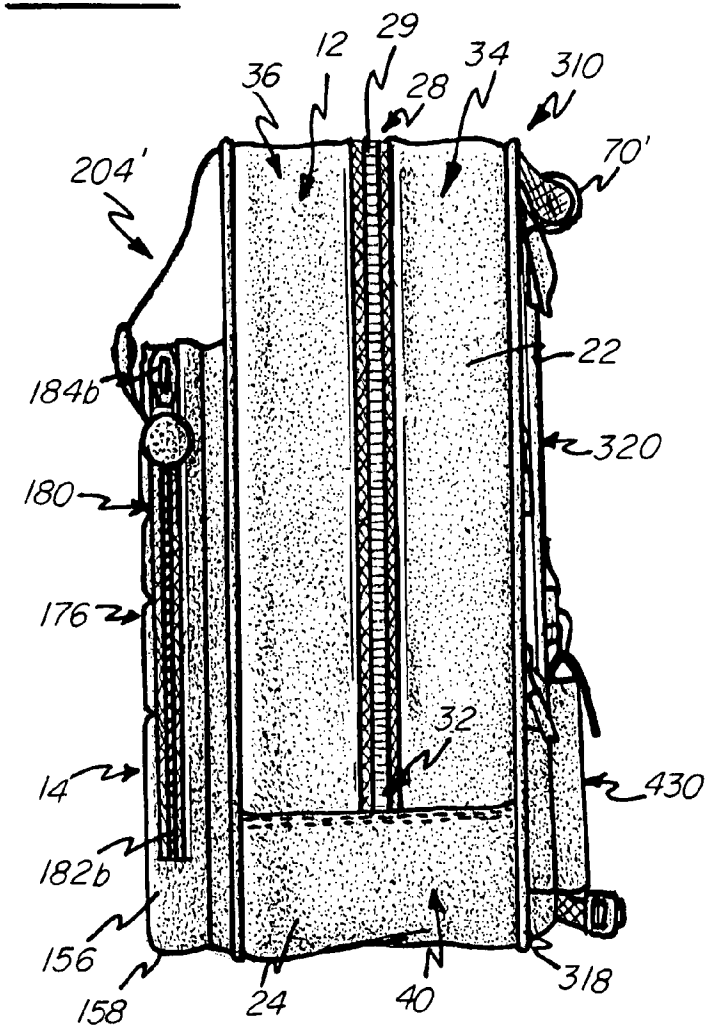
FIG. 15 is a right side elevational view of the tennis bag of FIG. 11.
Figure 14:
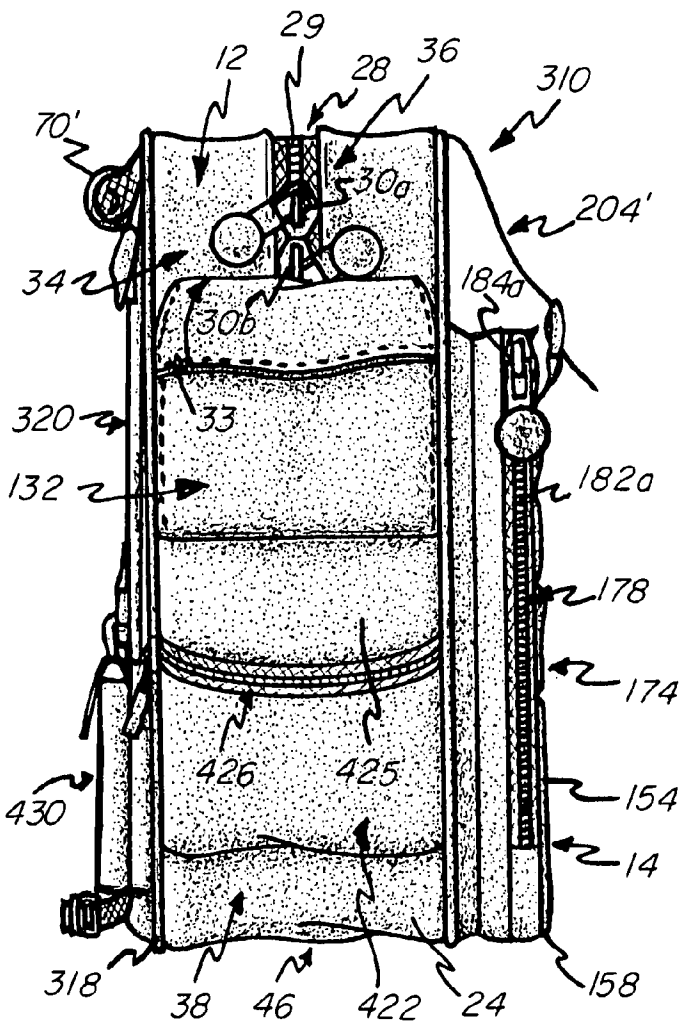
FIG. 14 is a left side elevational view of the tennis bag of FIG. 11.
Figure 16:
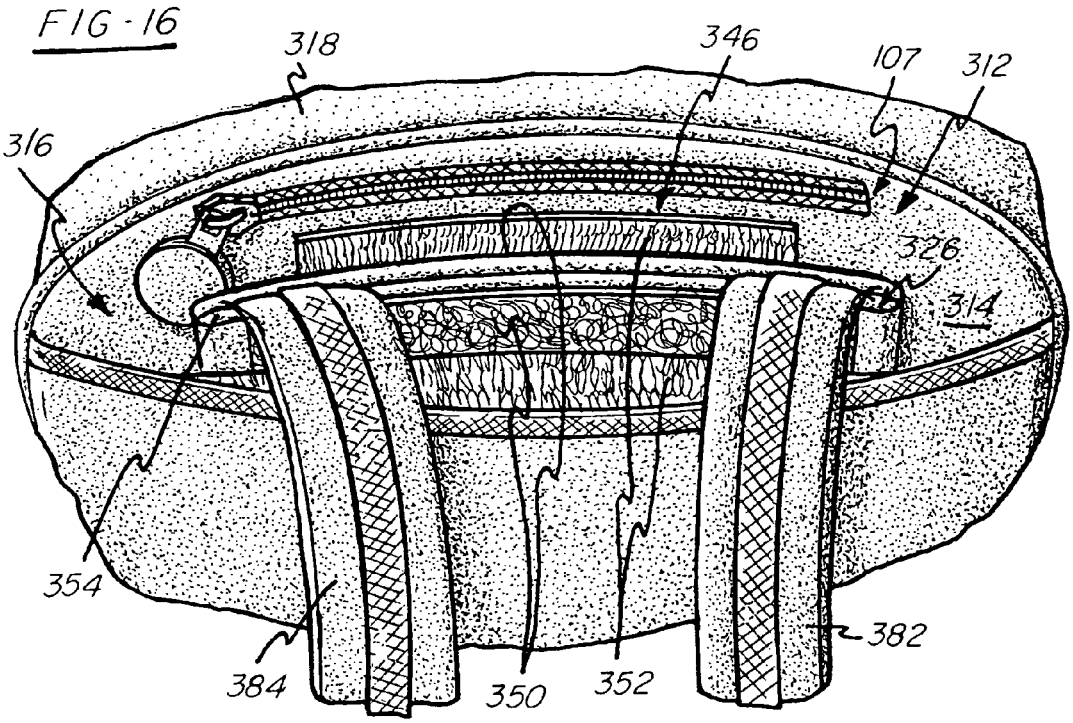
FIG. 16 is a detail top perspective view of the tennis bag of FIG. 11, showing a retaining panel coupled to first and second backpack straps and received within an open convertible pocket.
Figure 17:
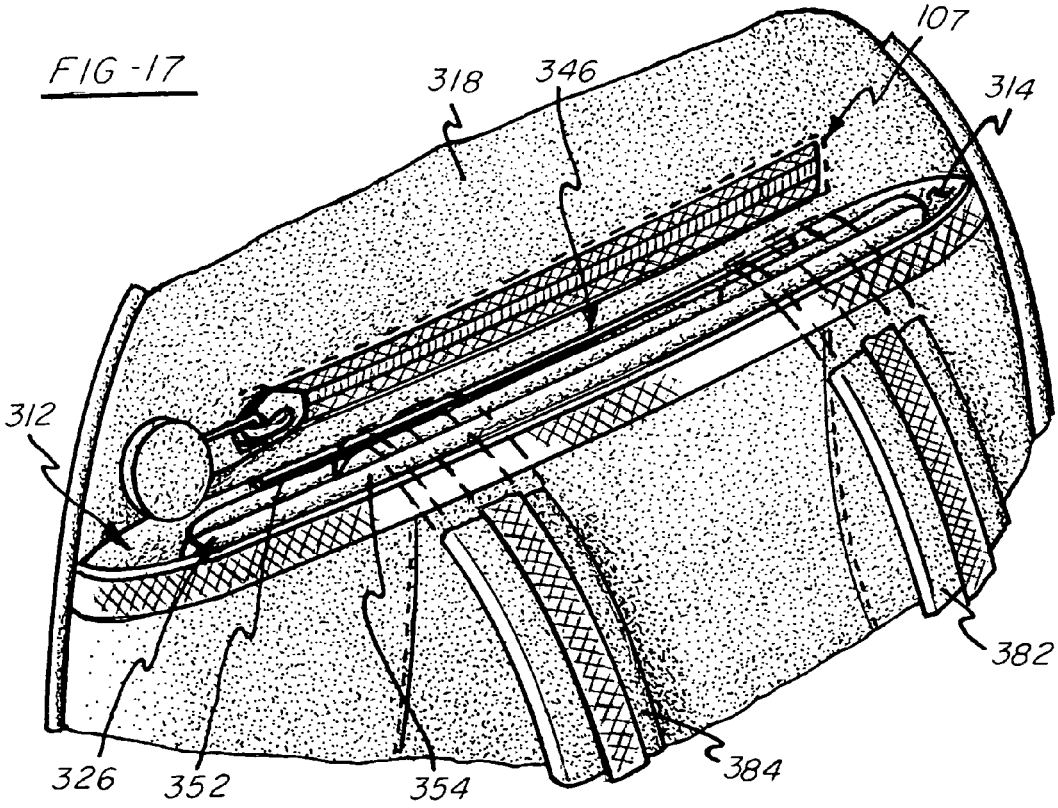
FIG. 17 is a detail top perspective view similar to FIG. 16, showing the convertible pocket closed and securing the retaining panel to the rear wall of the tennis bag of FIG. 11.

The tennis bag 310 includes a rear wall 318 which differs from the rear wall 18 of tennis bag 10 in several respects. As shown in FIGS. 13, 16, and 17, a convertible pocket 312 is positioned intermediate the fence hook pocket 107 and the storage pocket 106*a*. The convertible pocket 312 includes an interior 314 and an opening 316 in communication with the interior 314.

Figure 18:
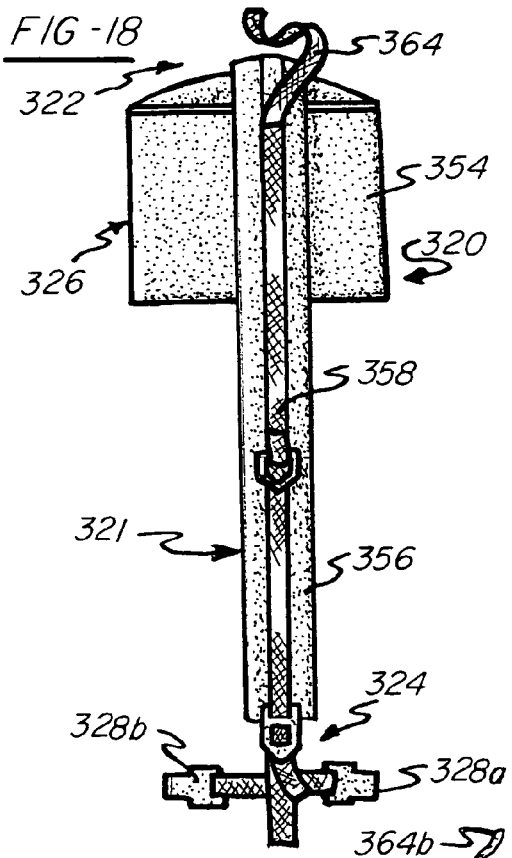
FIG. 18 is a rear elevational view of an illustrative single strap assembly.
Figure 21:
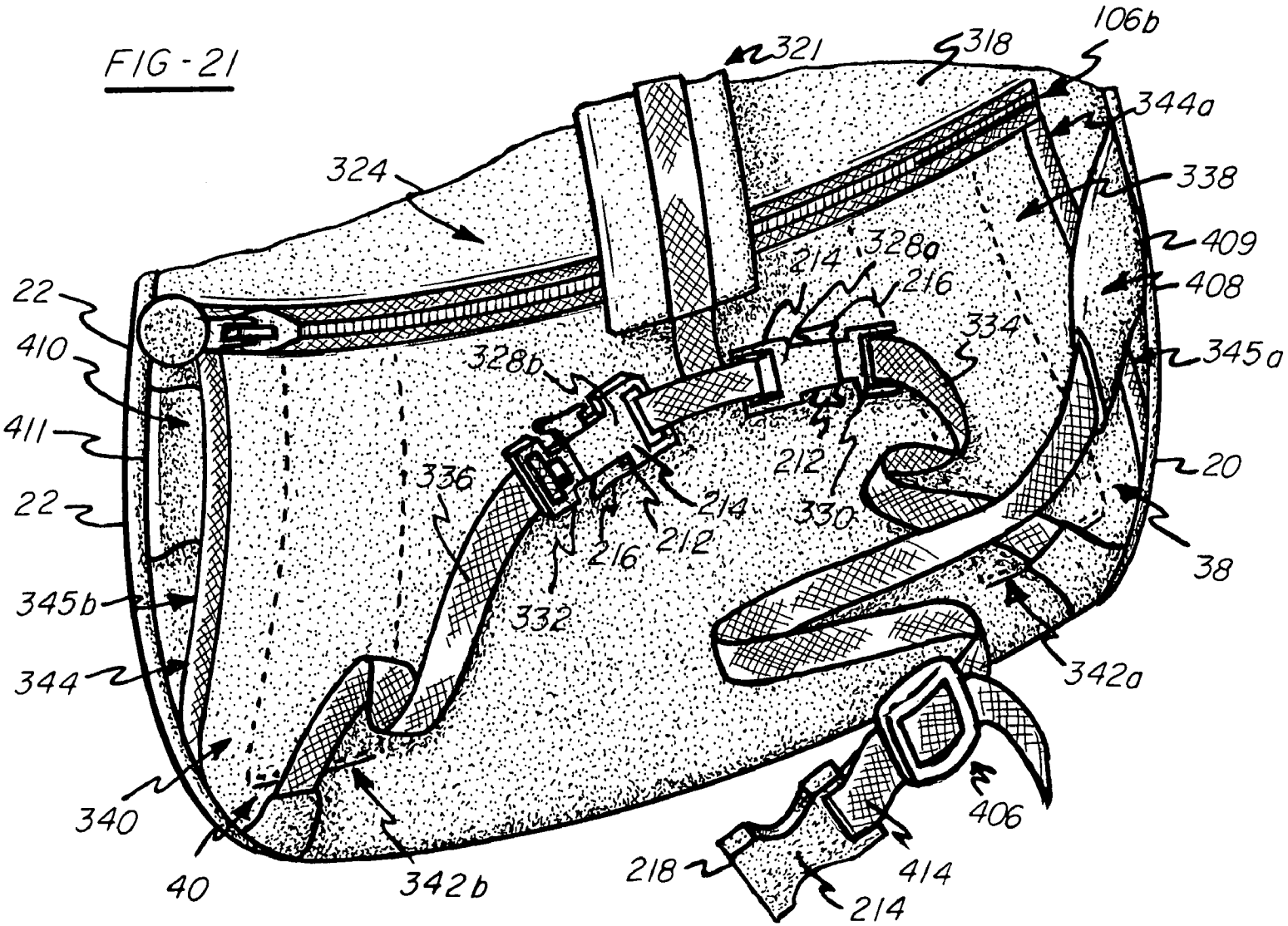
FIG. 21 is a partial rear perspective view of a lower portion of the accessory compartment.

As shown in FIG. 18, a first carrying strap assembly 320 includes a single sling strap 321 having an upper end 322 and a lower end 324. A retaining member 326 is coupled to the upper end 322, while a pair of releasable fastening members 328*a* and 328*b* are coupled to the lower end 324. Referring now to FIGS. 13, 18 and 21, a first mating fastening member 330 is coupled proximate the lower end of the rear wall 318 at the first lower corner portion 38 of the accessory compartment 12, and is configured to releasably couple with the releasable fastening member 328*a*. Likewise, a second mating fastening member 332 is coupled proximate the lower end of the rear wall 318 in spaced relation to the first mating fastening member 330. More particularly, the second mating fastening member 332 is coupled proximate the second lower corner portion 40 of the accessory compartment 12, and is configured to releasably couple with the releasable fastening member 328*b*. The fastening members 328*a* and 328*b* form a "T" with the lower end 324 of the sling strap 321. First and second mating fastening members 330 and 332 are each coupled to the rear wall 318 adjacent to the bottom wall 24 by a strap 334 and 336, respectively.

As shown in FIG. 21, the rear wall 318 further includes first and second strap storage pockets 338 and 340, each having a first opening 342*a*, 342*b* and a second opening 344*a*, 344*b*. The first and second openings 342*a*, 342*b* and 344*a*, 344*b* are in communication with an interior 345*a*, 345*b* of the respective first and second storage pockets 338 and 340. As may be appreciated, when not in use, the straps 334 and 336 may be folded around the first and second mating fastening members 330 and 332 and then inserted through the first opening 342*a*, 342*b* of the storage pockets 338 and 340. As such, the mating fastening members 330 and 332 along with the corresponding straps 334 and 336 may be conveniently tucked away and stored for convenience and protection.

Referring again to FIGS. 16 and 17, the retaining member 326 is configured to be removably received within the interior of the convertible pocket 312 by passing through the opening 316. A releasable securing member 346 is illustratively coupled to the interior 314 of the convertible pocket 312. The releasable securing member 346 is configured to releasably secure the retaining member 326 within the convertible pocket 312. Illustratively, the releasable securing member 346 comprises a hook and loop fastener having a loop portion 350 coupled to the exterior surface of the retaining member 326 and a hook portion 352 secured to facing surfaces of the interior 314 of the convertible pocket 312. In the illustrative embodiment, the retaining member 326 comprises a semi-rigid panel 354 covered with the loop portion 350. As may be appreciated, the panel 354 is slidably inserted through opening 316 into the interior 314 of the convertible pocket 312 when the pocket 312 is open (FIG. 16). Once in the proper position, the pocket interior 314 is then secured to the panel 354 by the hook portions 354 engaging the loop portion 350 as the pocket is closed (FIG. 17).

The sling strap 321 of FIG. 18 includes a padded portion 356 and a connecting or support portion 358. The upper end 322 of the strap 321 is secured to the panel 354, illustratively through conventional stitching. The support portion 358 includes an adjusting strap 364 which extends substantially parallel to the padded portion 356. A conventional adjustment buckle 369 is coupled to the rear wall 318 at upper center portion 36 of the accessory compartment 12 (FIG. 13). The strap 364 is threaded through the buckle 369 to provide additional support to the sling strap 321. Further, the buckle 369 may be utilized to adjust the effective length of the strap 364, thereby altering the position of the sling strap 321 relative to a user's back.

Figure 19:
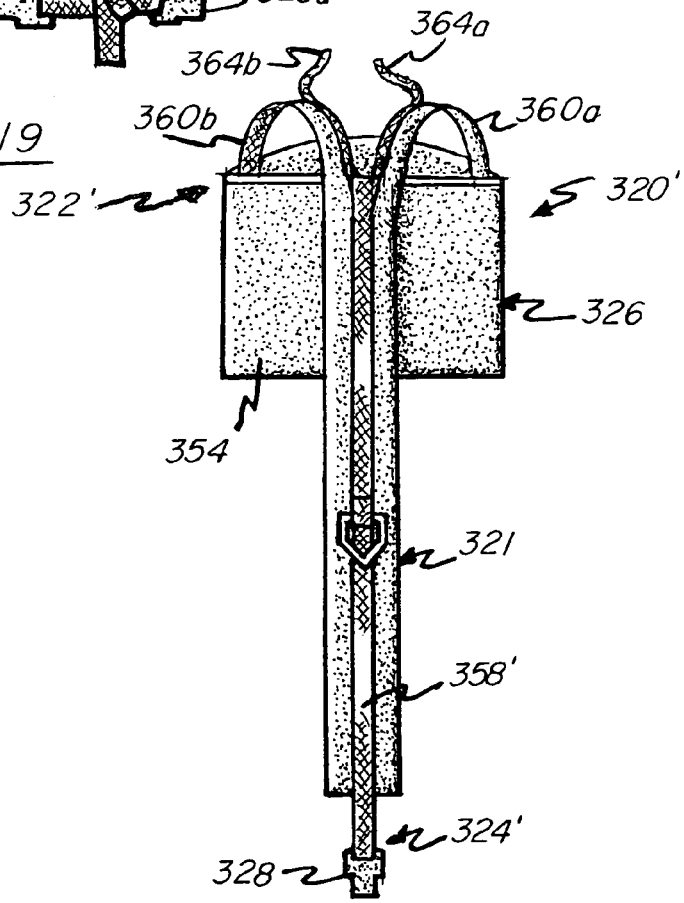
FIG. 19 is a rear elevational view of a further illustrative single strap assembly.

An alternative embodiment first carrying strap assembly 320' is illustrated in FIG. 19 and is similar to the strap assembly 320 of FIG. 18. However, the upper end 322' of sling strap 321' splits into first and second arms 360*a* and 360*b*, which are secured to panel 354, illustratively through conventional stitching. The support portion 358' includes adjusting straps 364*a* and 364*b* which extend substantially parallel to the first and second arms 360*a* and 360*b*. Conventional adjustment buckles 368*a* and 368*b* (FIG. 13) are coupled to the rear wall 318 on opposite sides of the buckle 369. The straps 364*a* and 364*b* may be threaded through buckles 368*a* and 368*b* in the manner detailed above. The lower end 324' of the strap assembly 320' includes a single fastening member 328 coupled to the support portion 358'.

Figure 20:
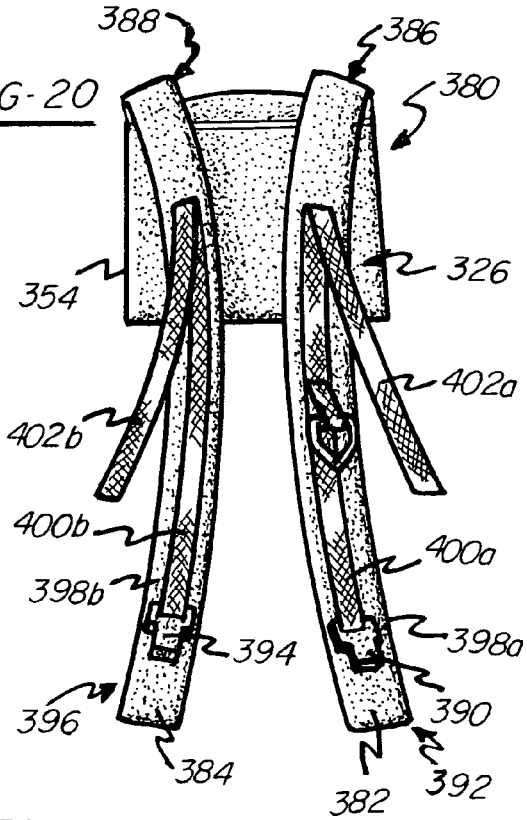
FIG. 20 is a rear elevational view of an illustrative backpack strap assembly.

A second carrying strap assembly 380 is illustrated in FIG. 20. The second carrying strap assembly 380 includes a retaining member 326 which is substantially identical to that detailed above with respect to the first carrying strap assembly 320. First and second laterally spaced backpack straps 382 and 384 are coupled to the panel 354 of the retaining member 326. More particularly, an upper end 386 of the first backpack strap 382 and an upper end 388 of the second backpack strap 384 are secured to the panel 354, illustratively through conventional stitching. A first releasable fastening member 390 is coupled to the lower end 392 of the first backpack strap 382, while a second releasable fastening member 394 is coupled to the lower end 396 of the second backpack strap 384. The first and second releasable fastening members 390 and 394 are configured to releasably couple with the first and second mating fastening members 328 and 330 supported by the accessory compartment 12.

Each backpack strap 382 and 384 includes a padded portion 398*a*, 398*b* and a connecting or support portion 400*a*, 400*b*. The support portions 400*a*, 400*b* include first and second adjusting straps 402*a* and 404*b* which are configured to operably couple with the first and second buckles 368*a* and 368*b* as detailed above with respect to the adjusting straps 364*a* and 364*b* of strap assembly 320'.

As may be appreciated, the first carrying strap assembly 320, 320' is interchangeable with the second carrying strap assembly 380, thereby making the tennis bag 310 convertible between different modes of operation. The first carrying strap assembly 320, 320' is configured for use in a one strap sling mode of operation wherein the sling strap 321, 321' is received over a single shoulder of a user. The second carrying strap assembly 380 is configured for use in a two strap backpack mode of operation wherein the first and second backpack straps 382 and 384 are received over the first and second shoulders of a user. The retaining member 326, along with the respective releasable fastening members 328, 390 and 394, facilitate this interchangeability of the first and second carrying strap assemblies 320, 320' and 380.

With further reference to FIGS. 13 and 21, a waist strap 406 is coupled to a lower portion of the rear wall 318 at the lower portion 35 of the accessory compartment 12. The waist strap 406 includes a first portion 408 having a first end 409 coupled proximate the first side wall 20, and a second portion 410 having a first end 411 coupled proximate the second side wall 22. A second end 412 of the first portion 408 and a second end 414 of the second portion 410 may be releasably coupled together through a releasable coupling 416. More particularly, the second end 412 of the first portion 408 includes a releasable fastening member 418, while the second end 414 of the second portion 410 includes a mating fastening member 420. In the illustrative embodiment, the releasable coupling 416 comprises a quick connect and release device similar to the releasable coupling 210 detailed above. More particularly, the releasable coupling illustratively includes a male portion 212 receivable within a female portion 214. The male portion 212 includes a pair of spring arms 216 which are configured to be lockingly received within an opening 218 of the female portion 214 in the manner described herein above.

When not in use, the first and second portions 408 and 410 of the waist strap 406 may be conveniently received within the first and second strap storage pockets 338 and 340, respectively. More particularly, the first portion 408 of the waist strap 406 may be folded and received within the second opening 344*a* of the first strap storage pocket 338, while the second portion 410 of the waist strap 406 may be folded and received within the second opening 344*b* of the second strap storage pocket 340.

A handle 70' is coupled to the rear wall 318 adjacent to the upper center portion 36 of the accessory compartment 12. A pair of flexible straps 421*a* and 421*b* couple the handle 70' to the rear wall 318.

Figure 22:
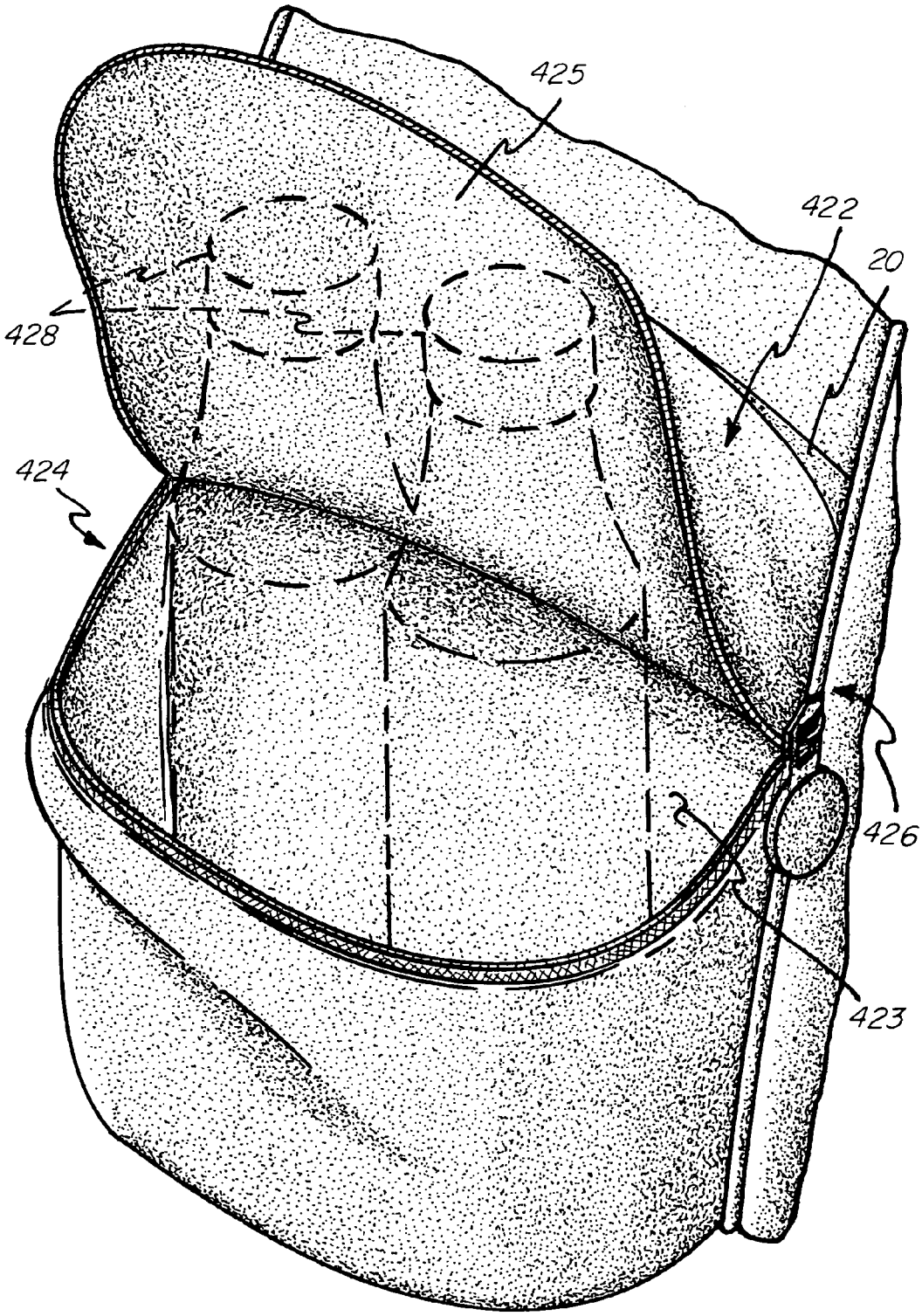
FIG. 22 is a detailed perspective view of the tennis bag of FIG. 10, showing the cooler compartment, with a pair of water bottles illustrated in phantom for illustrative purposes.

With reference now to FIGS. 1 and 22, a cooler compartment 422 is supported by the first side wall 20 adjacent the lower portion 35 of the accessory compartment 12. The cooler compartment 422 includes a lining 423, illustratively formed from a poly-vinyl-chloride (PVC) or similar insulating material. In one illustrative embodiment, layers of insulating foam may be sandwiched between external layers of PVC or other suitable material. An opening 424 to the compartment 422 may be closed by a flap or cover 425. A closing member 426, illustratively a conventional zipper, is provided to seal the opening 424. The compartment 422 may be used to store water bottles 428 (shown in phantom in FIG. 22), power bars, lipstick, or any other item the user wishes to remain cold.

Figure 23:
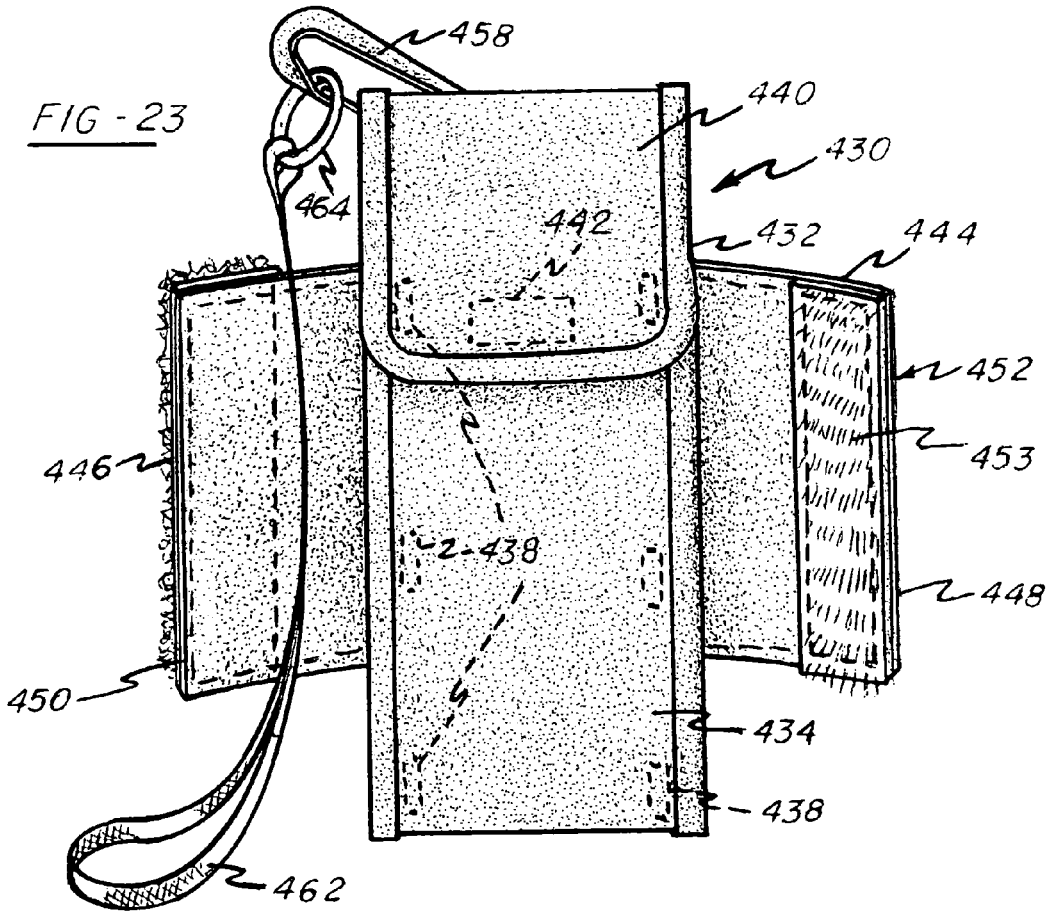
FIG. 23 is a front elevational view of the mobile phone holder configured to be releasably coupled to a carrying strap of the tennis bags of FIGS. 1 and 10.
Figure 24:
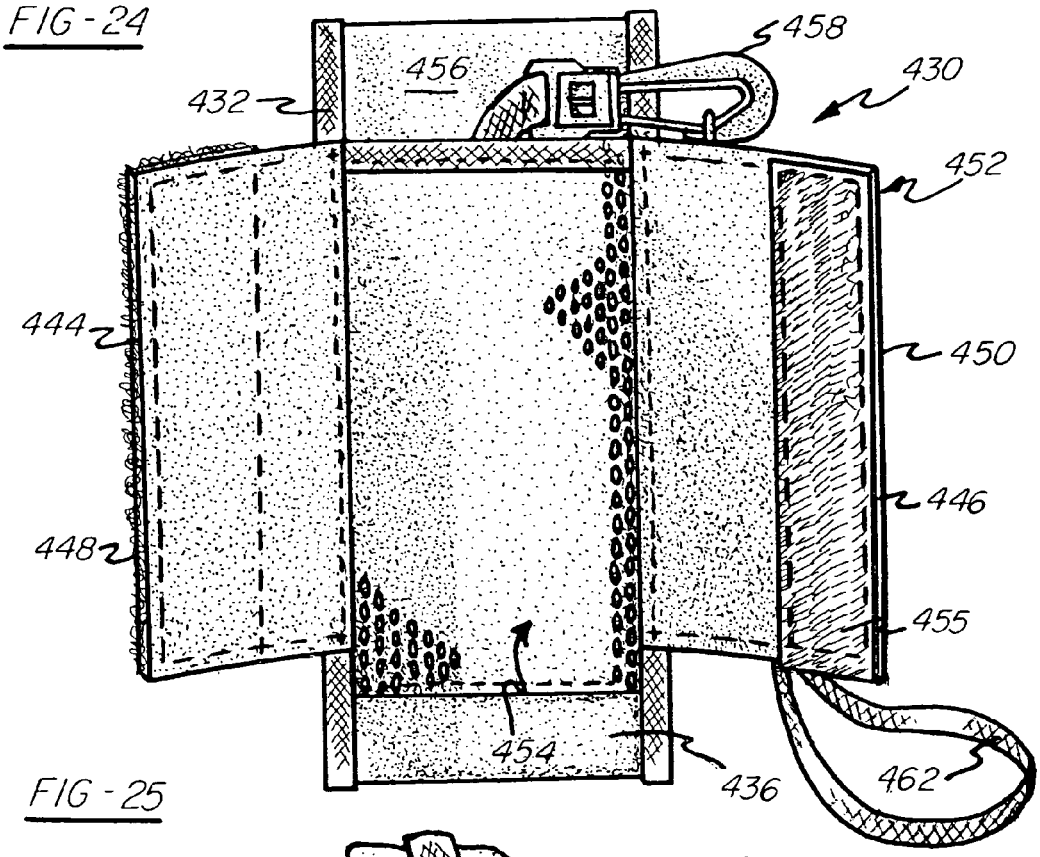
FIG. 24 is a rear elevational view of the mobile phone holder of FIG. 23.
Figure 25:
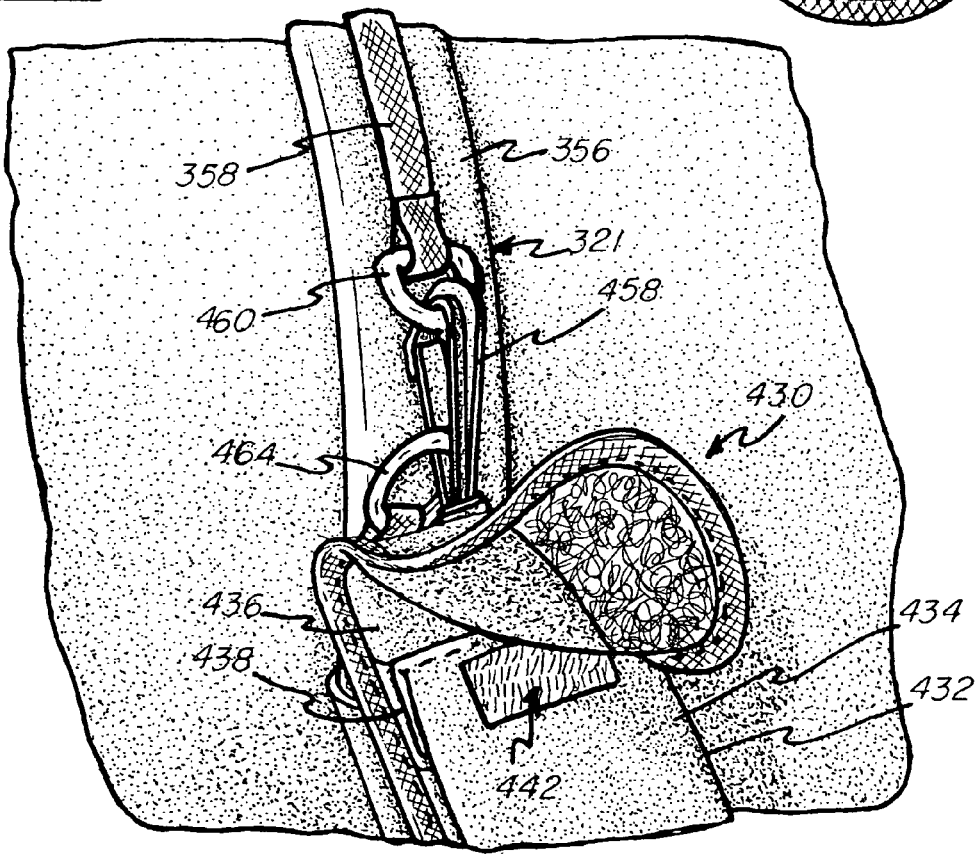
FIG. 25 is a partial perspective view of the upper portion of the mobile phone holder of FIG. 23 secured to a carrying strap.

As with the tennis bag 10 described above, the tennis bag 310 illustratively includes a cellular or mobile phone holder 430 releasably coupled thereto. The phone holder 430 may be releasably coupled to either the sling strap 321, 321' of the first carrying strap assembly 320, 320' or to either of the first and second backpack straps 382 and 384 of the second carrying strap assembly 380. As shown in FIGS. 23-25, the phone holder 430 includes a phone compartment or case 432 including a first panel 434, a second panel 436, and a plurality of resilient straps 438 connecting the first panel 434 and the second panel 436. The resilient straps 438 provide for movement between the first panel 434 and the second panel 436 to accommodate phones of different sizes. A cover 440 extends from the second panel 436 and may be selectively secured to the first panel 434 to retain the phone within the case 432. A releasable securing member 442, such as a hook and loop fastener, releasably couples the cover 440 to the first panel 434. First and second retaining flaps or panels 444 and 446 extend outwardly from the second panel 436 and have ends 448 and 450 which may be releasably secured together by a releasable securing device 452, such as a hook and loop fastener including a loop portion 453 and a hook portion 455.

The panels 444 and 446 extend around the respective strap 321, 321', 382, 384 of the backpack 310 to secure the holder 430 thereon. An accessory storage compartment or pocket 454 is coupled to the rear surface 456 of the second panel 436 and illustratively is formed from a resilient mesh material to facilitate viewing of items contained therein. The accessory storage pocket 454 may be used to store items such as identification and sunglasses. A conventional snap clip 458 is also coupled to the rear surface 456 of the first panel and may be used to clip the phone holder 430 to various items. For example, the snap clip 458 may be secured to a D-ring 460 which is coupled to the backpack strap 321, 321', 382, 384. A lanyard 462 and a ring 464 may be attached to the clip 458 and facilitate carrying of the phone holder 430 separately from the bag 310.

Turning now to FIGS. 26-32, a tennis bag 510 according to a further illustrative embodiment of the present invention is shown. The tennis bag 510 includes many similar features to the tennis bag 10 identified above. As such, like features are identified with like reference numerals.

More particularly, the tennis bag 510 includes an accessory compartment 512 coupled to a racquet compartment 514. The accessory compartment 512 includes a front wall 516 coupled to a rear wall 518 through first and second side walls 520 and 522. A carrying strap 542 has an upper end 544 coupled to the rear wall 518 near an upper portion 534, illustratively an upper center portion 536, of the accessory compartment 512, and a lower end 546 which supports a pair of releasably fastening members 550*a*, 550*b*, illustratively conventional spring clips. The fastening members 550*a*, 550*b* are configured to couple with first and second mating fastening members 552 and 554, illustratively conventional loops or rings which, in turn, are coupled to the rear wall 518 proximate opposing lower corner portions 538 and 540 of the accessory compartment 512. The strap 542 includes a connecting member 547, illustratively a conventional zipper, which converts the strap 542 from a single sling strap to a pair of backpack straps 542*a* and 542*b*. As such, the strap 542 may be converted from a backpack strap mode of operation to a single sling strap mode of operation by changing the lower coupling from a pair of spaced apart fastening members 552 and 554 (FIG. 29) to a single corner fastening members 552, 554 (FIG. 30).

The upper portion 534 of the accessory compartment 512 includes an upwardly extending open top 526. The upper portion 534 surrounds the open top 526 and further includes a plurality of apertures 527. An accessory compartment closing member, illustratively a draw string 528, passes through the apertures 527 and may be used to cinch and close the top 526 of the accessory compartment 512. A lock 529 is coupled proximate the opposing ends 530*a*, 530*b* of the draw string 528 and includes a spring biased clamping member 531 so that the lock 529 may be selectively secured in a desired position along the draw string 528 thereby securing an adjusted effective length of draw string 528 passing through the apertures 527 (FIG. 31).

Figure 26:
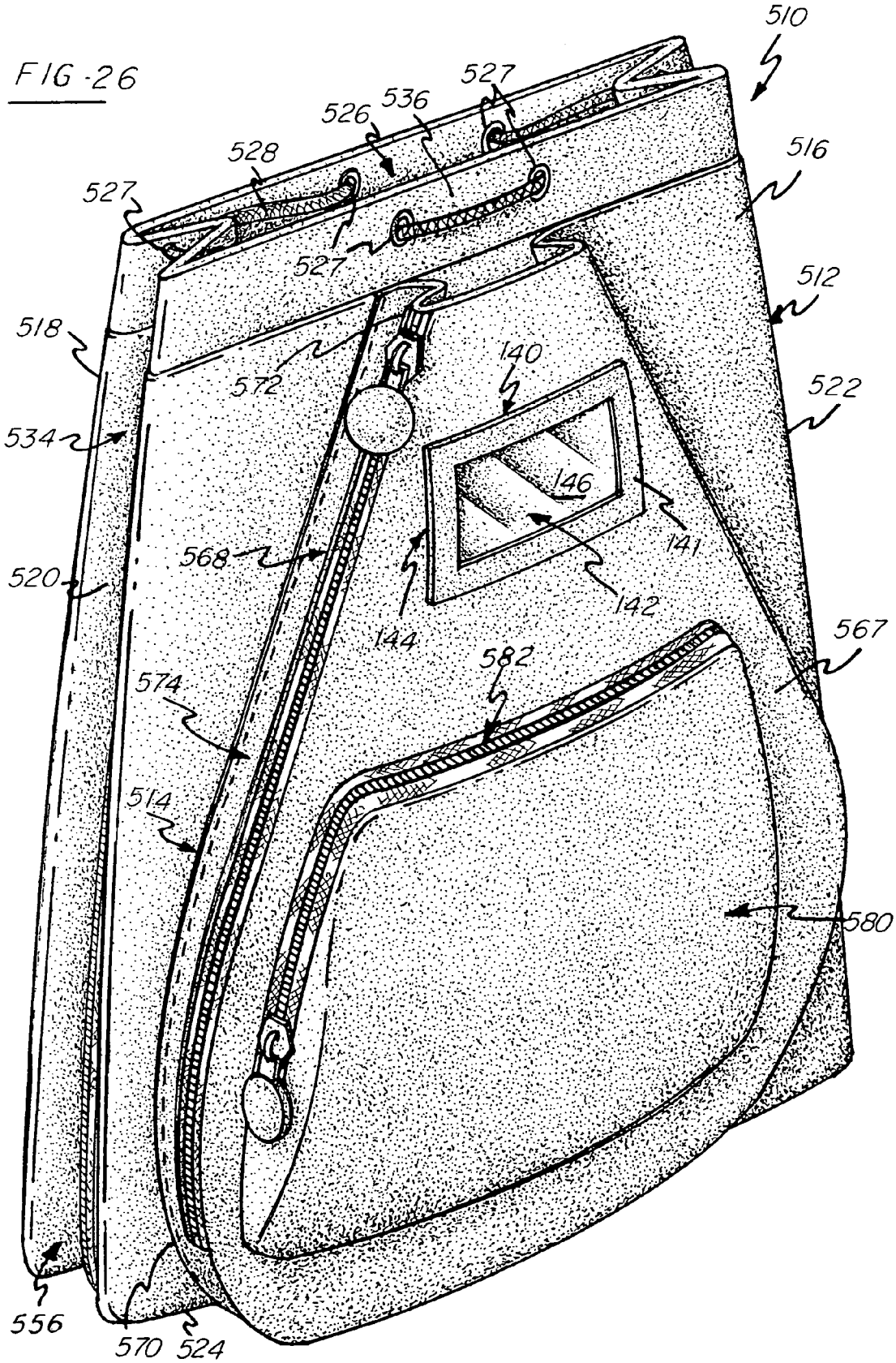
FIG. 26 is a perspective view as seen from the top, front, and left side of a tennis bag according to a further illustrative embodiment of the present invention.
Figure 27:
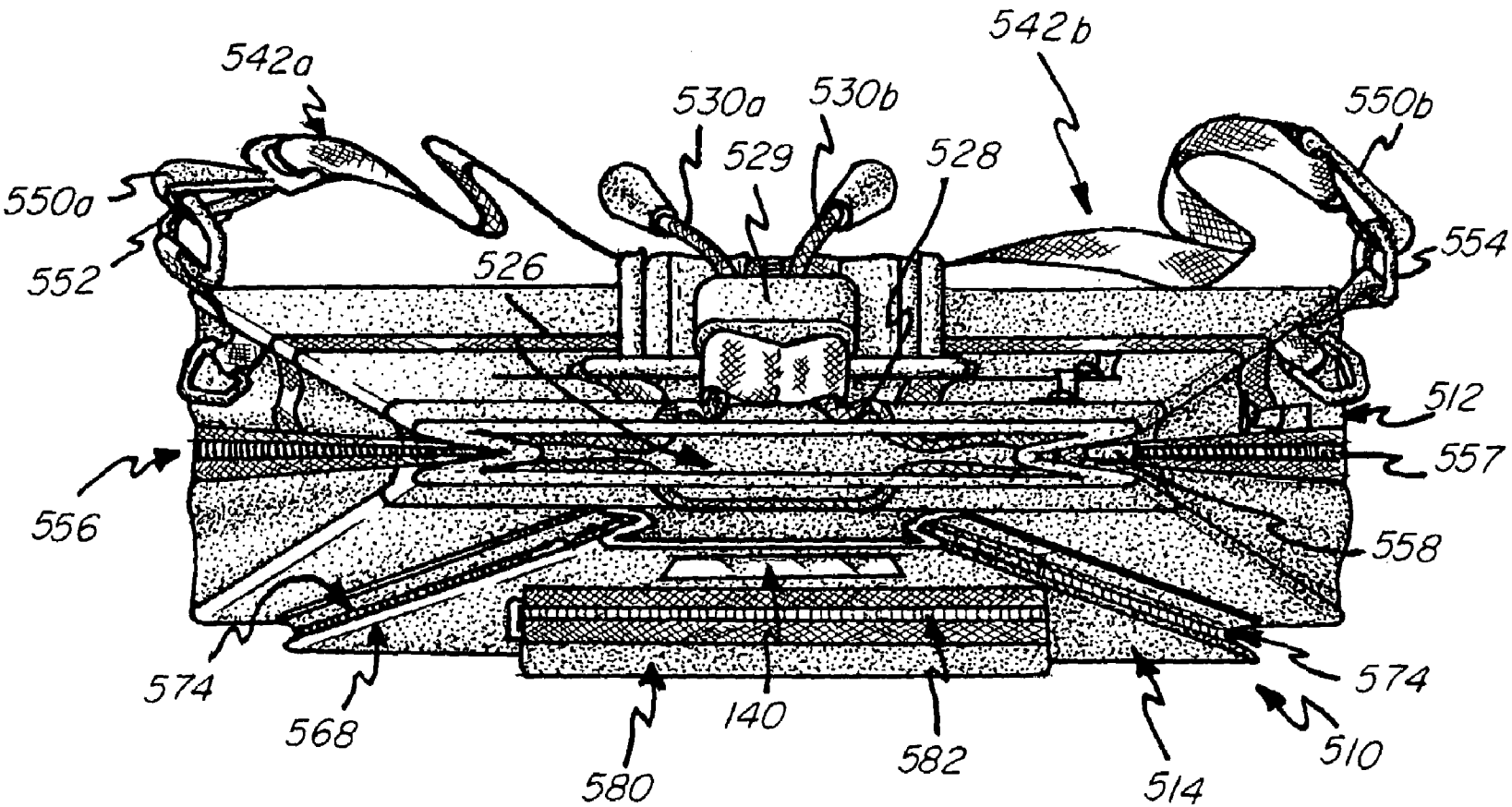
FIG. 27 is a top plan view of the tennis bag of FIG. 26, showing a top opening to the accessory compartment and a draw string configured to close the opening.
Figure 31:
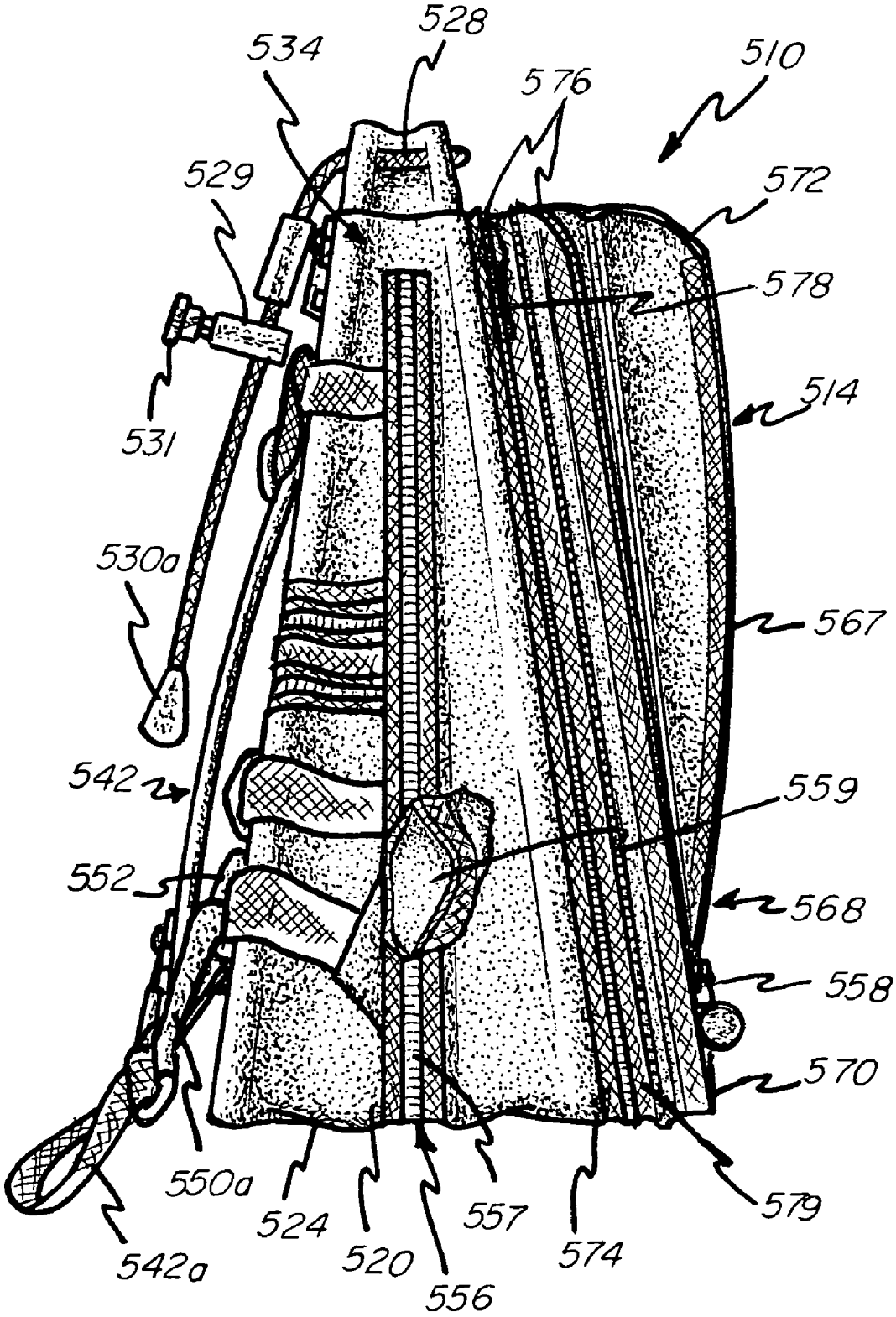
FIG. 31 is a left side elevational view of the tennis bag of FIG. 26, showing the accessory compartment in a contracted configuration, the racquet compartment in an expanded configuration, and with the racquet compartment partially open.
Figure 32:
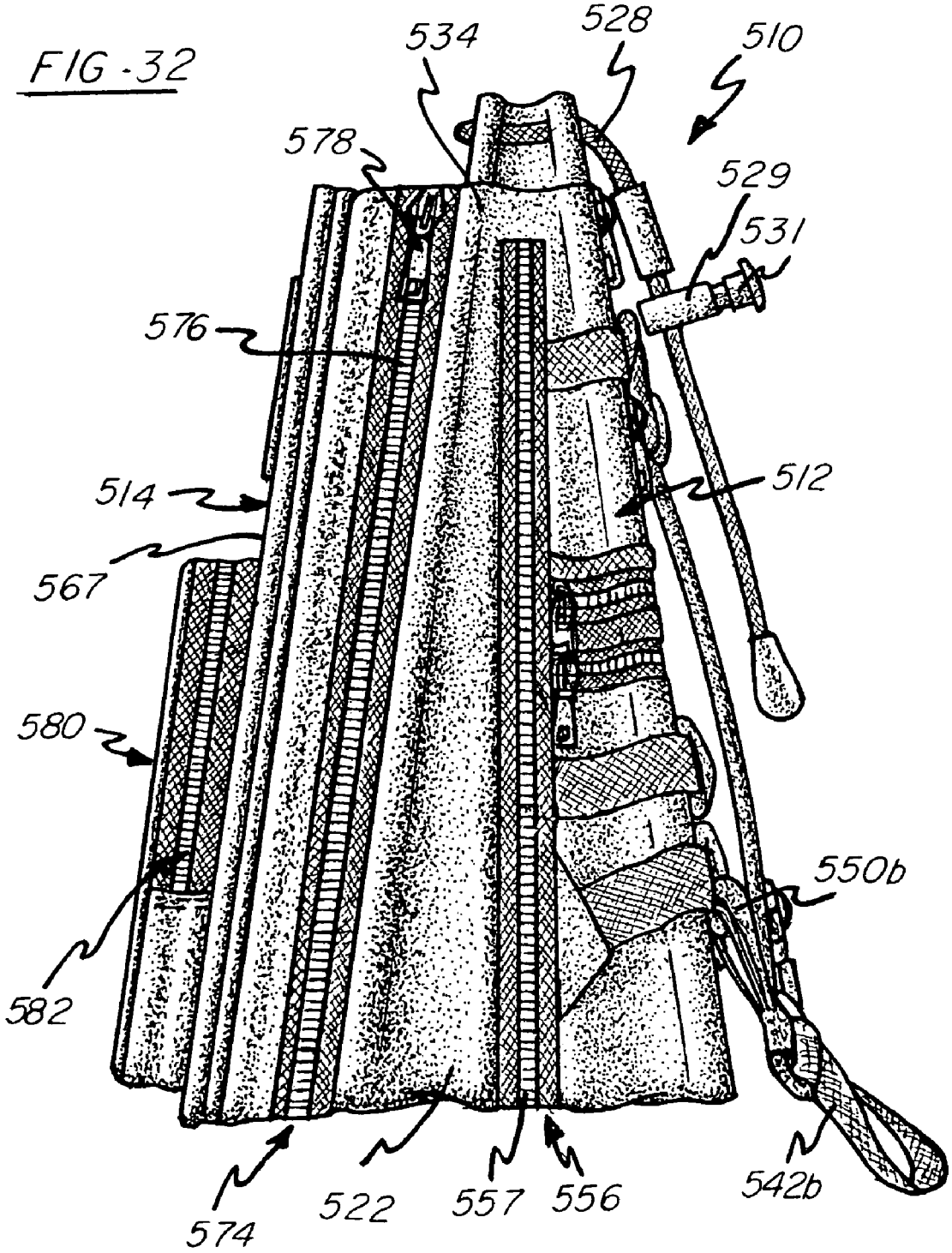
FIG. 32 is a right side elevational view of the tennis bag of FIG. 26, showing the accessory compartment and the racquet compartment in contracted configuration.

Referring now to FIGS. 26, 27, 31 and 32, an accessory compartment expansion member 556 extends from proximate the upper portion 534 of the accessory compartment 512 along the first side wall 520 downwardly around the bottom wall 524, then upwardly along the second side wall 522 toward the upper portion 534 of the accessory compartment 512. The expansion member 556 illustratively comprises a conventional zipper, including a zipper track 557 and slide or pull 558 movable therealong (FIG. 27). The zipper 556 straddles a fabric expansion panel 559 that provides additional storage capacity to the accessory compartment when open (FIG. 31).

Figure 28:
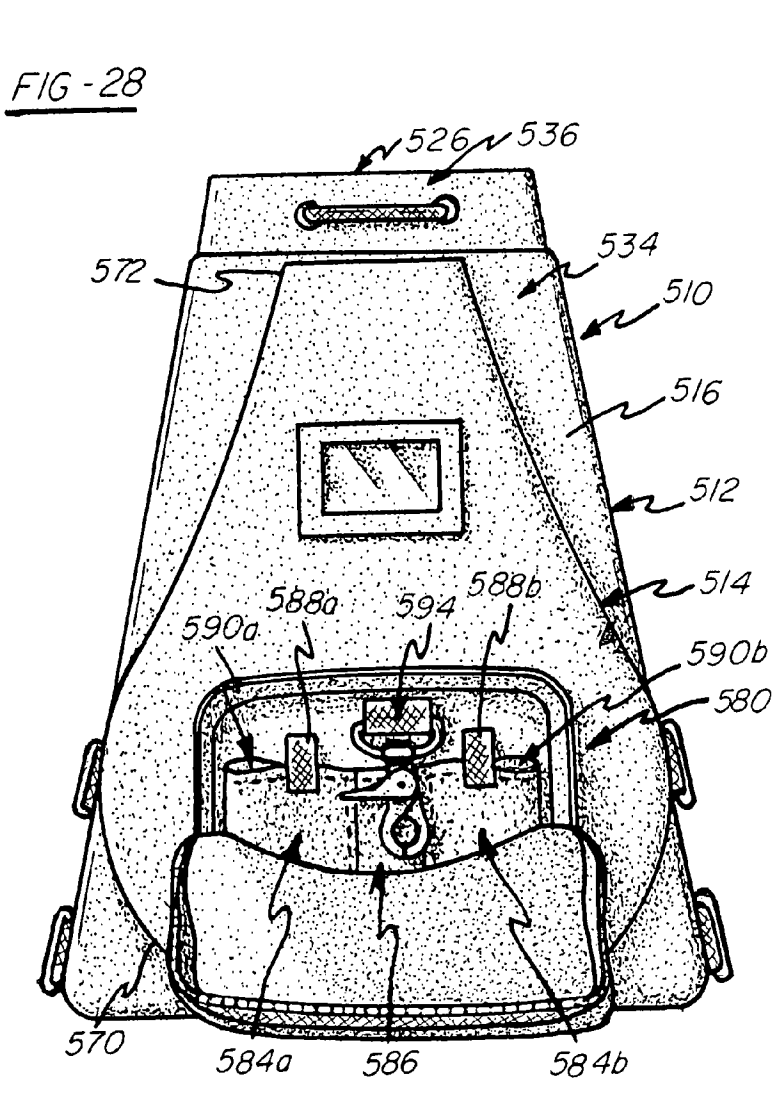
FIG. 28 is a front elevational view of the tennis bag of FIG. 26, with the front pocket partially open to show the interior thereof.

With reference to FIGS. 26, 28, and 31, the racquet compartment 514 is formed by a racquet panel 567 coupled to the front wall 516, and shaped to conform to the shape of a racquet head. The racquet compartment 514 includes a closing member 568, illustratively a conventional zipper extending upwardly from proximate a bottom edge 570 to a top edge 572. A racquet compartment expansion member 574, illustratively a second conventional zipper including a zipper track 576 and a slide 578 (FIG. 32), extends substantially around the outer periphery of the racquet compartment 514 and facilitates expansion thereof. More particularly, the zipper track 576 straddles a fabric expansion panel 579 (FIG. 31) which is released when the zipper 574 is open. As may be appreciated, the racquet compartment 514 may be expanded to hold multiple racquets.

An outer pocket 580 is formed on the outside of the racquet compartment 514 and includes a zipper 582 to seal items therewithin. As shown in FIG. 28, the pocket 580 includes first and second securable pockets 584*a* and 584*b* and a center pocket 586. Releasable fasteners 588*a* and 588*b*, are configured to close upper openings 590*a* and 590*b* of pockets 584*a* and 584*b*. A key chain holder 594 is supported above pocket 592 and may include the same structure as detailed herein above.

Figure 29:
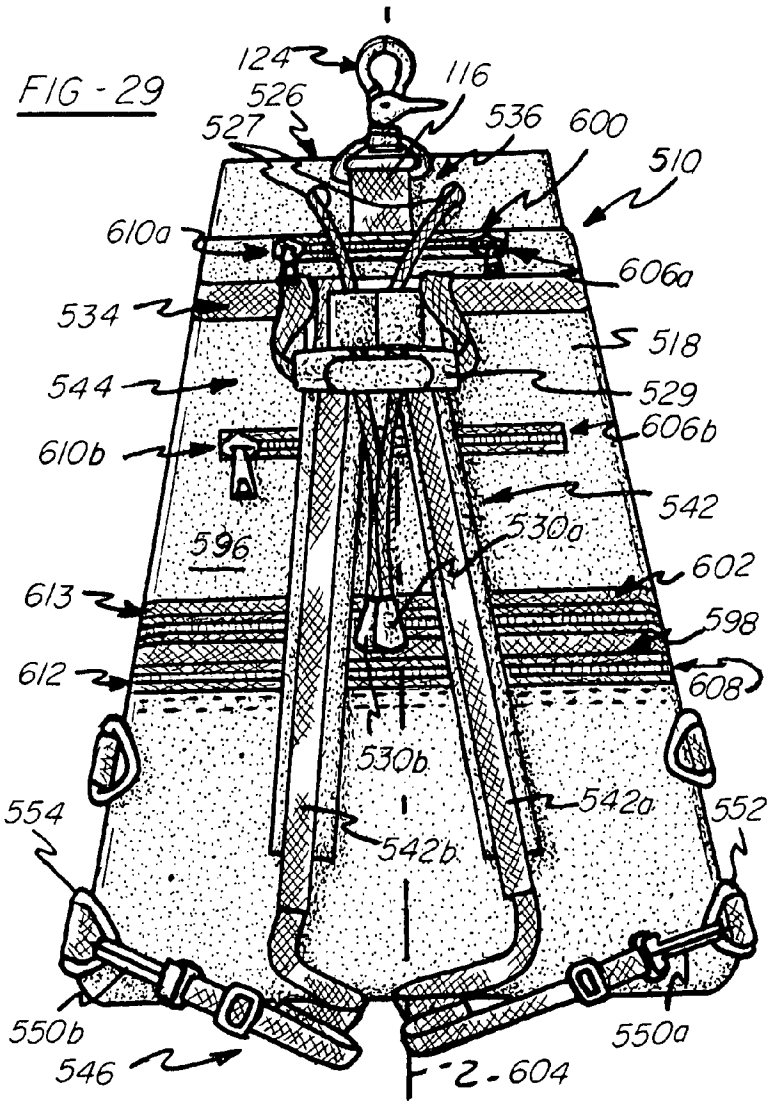
FIG. 29 is a rear elevational view of the tennis bag of FIG. 26, showing a backpack carrying strap configuration.
Figure 30:
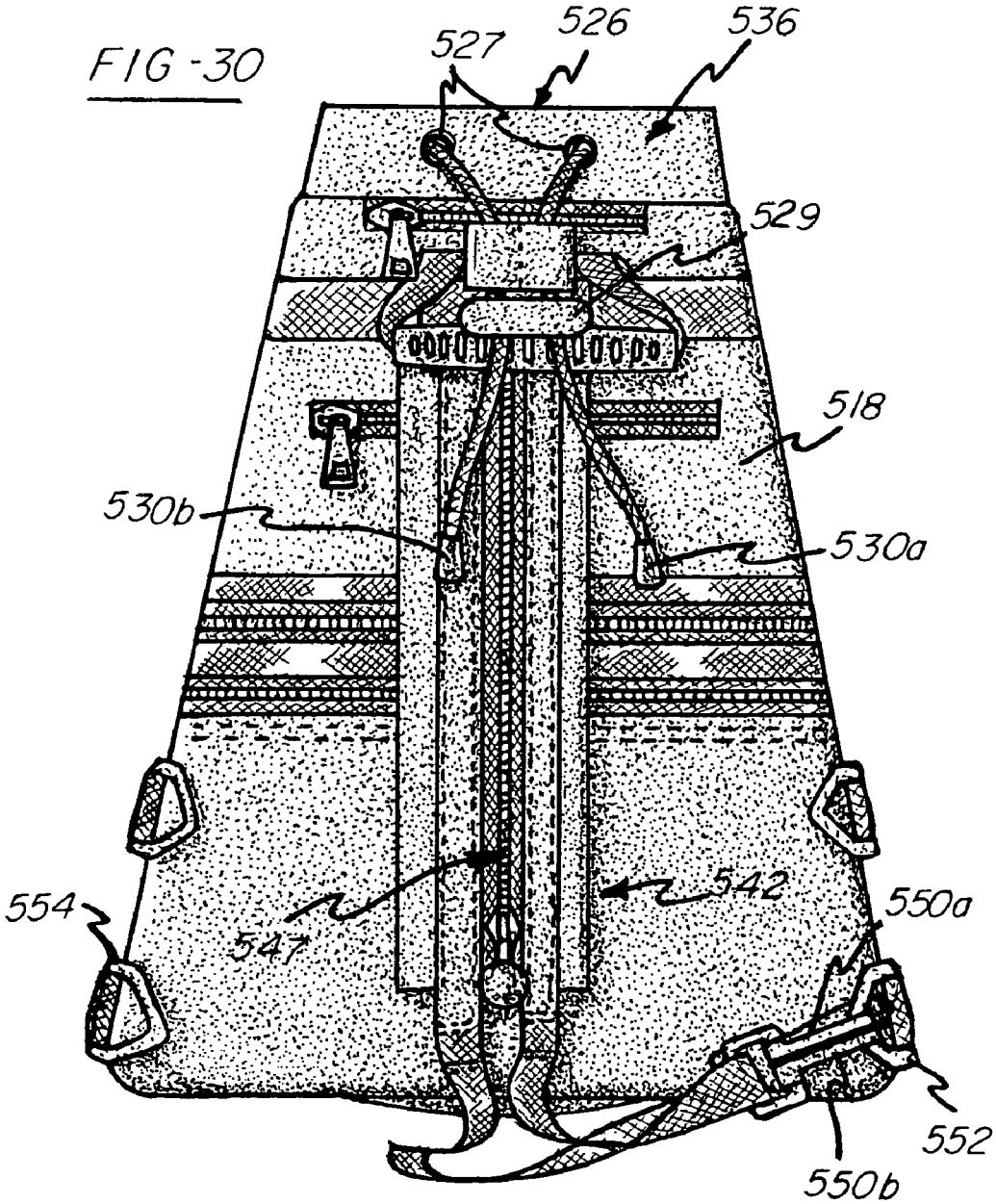
FIG. 30 is a rear elevational view similar to FIG. 29, showing a single sling carrying strap configuration.

Turning now to FIG. 29, an outside surface 596 of the rear wall 518 includes pockets 598 and 600. The outside surface 596 further includes an accessory compartment access 602. Each pocket 598 and 600 and the accessory compartment access 602 is laterally aligned with respect to a longitudinal center axis 604 and are sized to receive a variety of accessories. The external pockets 598 and 600 allow for quick and easy access to items stored therein. Since pockets 598 and 600 are positioned on the outside surface 596 of the rear wall 518, a closing member 606*a*, 606*b* and 608 is provided to close respective openings 610*a*, 610*b*, and 612 of each pocket. The opening 610*a* provides upper access to pocket 600 and the opening 610*b* provides lower access to the pocket 600, thereby facilitating easy access to items located inside the pocket 600.

Pocket 600 also includes a connector 116 and fence hook 124 which is substantially the same as that detailed above with respect to FIG. 9. The hook 124 is configured to extend from the upper access opening 610*a* of the pocket 600 and clip onto a fence, or other vertical surface, in order to hang or support the bag 510 therefrom.

The accessory compartment access 602 allows for direct access to the accessory compartment 512 without opening the draw string 528. A closing member 613, illustratively a conventional zipper, is provided to close the accessory compartment access 602. It should be appreciated that the accessory compartment access 602 can be located anywhere on the tennis bag 510.

Figure 33:
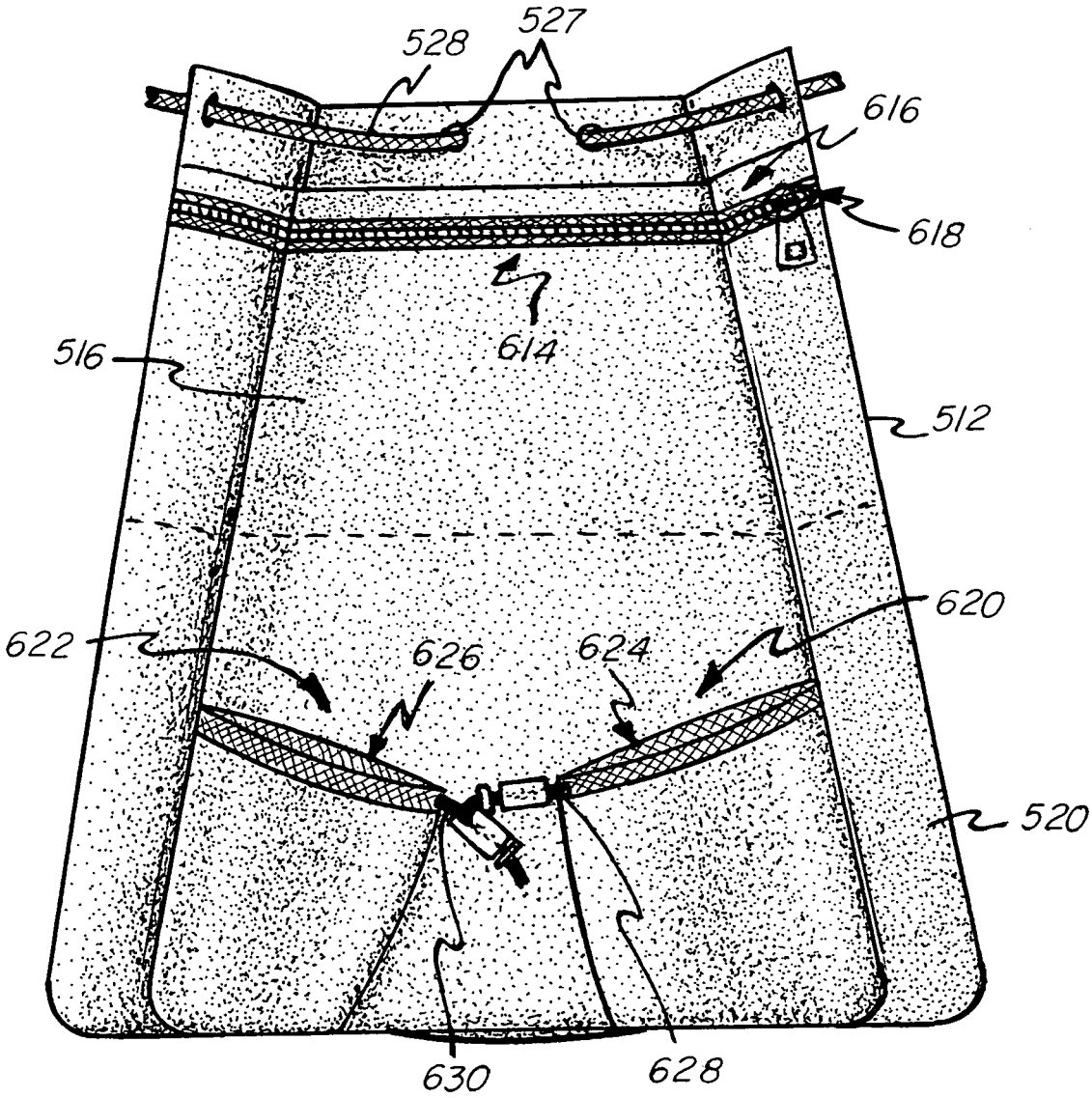
FIG. 33 is a rear elevational view of the tennis bag of FIG. 26 with the rear wall removed to show the interior of the accessory compartment including a plurality of pockets.

Referring now to FIG. 33, the interior 612 of the accessory compartment 512 may be utilized to carry tennis or other related accessories, including apparel, towels, footwear, tennis balls, wallets, keys, business cards, pens, personal hygiene products, watches, jewelry, glasses, etc. An upper pocket 614 defines an upwardly accessible opening 616 which may be selectively closed by a closing member 618, illustratively a conventional zipper. First and second lower pockets 620 and 622 are suspended from opposing side walls 520 and 522 and include upwardly accessible openings 624 and 626. Closing members 628 and 630, illustratively draw strings, are provided to selectively close the openings 624 and 626.

Although the invention has been described in detail with reference to certain preferred embodiments, variations and modifications exist within the spirit and scope of the invention as described and defined in the following claims.

The invention claimed is:

1. A tennis bag comprising:

a front wall;

a rear wall positioned in spaced relation to the front wall and defining a longitudinal center axis;

opposing first and second side walls connecting the front wall and the rear wall, the first and second side walls meeting at an apex;

a bottom wall coupled to the first and second side walls, the front wall, and the rear wall;

an accessory compartment defined by the front wall and the rear wall, the accessory compartment including an upper center portion, a first lower corner portion laterally offset from the center upper portion, and a second lower corner portion laterally offset from the upper center portion;

an accessory compartment closing member configured to close an opening to the accessory compartment between the front wall and the rear wall, the accessory compartment closing member extending within portions of both the first side wall and the second side wall;

a racquet panel coupled to the front wall;

a racquet compartment defined by the front wall and the racquet panel;

a racquet compartment closing member coupled to the racquet panel and configured to close at least a portion of an opening between the front wall and the racquet panel;

a carrying strap having an upper end and a lower end, the upper end being coupled to the upper center portion of the rear wall proximate the longitudinal center axis and proximate the apex;

a releasable fastening member coupled to the lower end of the strap;

a first mating fastening member coupled proximate the first lower corner portion of the accessory compartment and laterally offset from the longitudinal center axis;

a second mating fastening member coupled proximate the second lower corner portion of the accessory compartment, the second mating fastening member positioned in spaced relation to the first mating fastening member and laterally offset from the longitudinal center axis; and wherein the releasable fastening member is configured to be selectively coupled to one of the first and second mating fastening members.

2. The tennis bag of claim 1, wherein the carrying strap includes a support portion, a padded portion, and a plurality of loops coupling the padded portion to the support portion.

3. The tennis bag of claim 2, further comprising a carrying handle coupled proximate the upper center portion of the storage compartment, the carrying handle including a use mode of operation in which the carrying handle extends above the upper center portion of the accessory compartment, and a storage mode of operation in which the carrying handle is secured intermediate the padded portion and at least one of the loops.

4. The tennis bag of claim 1, further comprising a center partition received within the racquet compartment and defining a first racquet pocket and a second racquet pocket in spaced relation to the first racquet pocket.

5. The tennis bag of claim 4, further comprising a first racquet pocket closing member coupled to the center partition and configured to at least partially close an opening to the first racquet pocket, and a second racquet pocket closing member coupled to the center partition and configured to at least partially close an opening to the second racquet pocket.

6. The tennis bag of claim 1, wherein the racquet compartment includes opposing first and second sides, a bottom, and a top defining a generally truncated egg-shaped cross-section configured to conform to the shape of a racquet head.

7. The tennis bag of claim 1, wherein the carrying strap is coupled to a retaining member, and the rear wall includes a convertible pocket configured to receive the retaining member.

8. The tennis bag of claim 7, further comprising a releasable securing member coupled to an interior of the convertible pocket, the securing member being configured to releasably secure the retaining member within the convertible pocket.

9. The tennis bag of claim 1, wherein the accessory compartment includes a ball storage pocket coupled to at least one of the rear wall and the front wall, the ball storage compartment configured to receive a canister of tennis balls and being angled upwardly from horizontal.

10. The tennis bag of claim 1, further comprising a pocket coupled to at least one of the front wall and the rear wall, a strap having a first end and a second end, the first end being coupled within the pocket, and a fence hook coupled to the second end of the strap.

11. The tennis bag of claim 1, further comprising a cooler compartment positioned in spaced relation to the racquet compartment.

12. The tennis bag of claim 1, further comprising a mobile phone holder releasably coupled to the carrying strap.

13. The tennis bag of claim 1, wherein the accessory compartment closing member comprises a zipper extending from a first end proximate the bottom wall upwardly within the second side wall around the apex to a second end within the first side wall.

14. The tennis bag of claim 1, wherein the accessory compartment closing member comprises a draw string extending around the upper center portion of the accessory compartment.

15. A tennis bag comprising:

a front wall;

a rear wall positioned in spaced relation to the front wall and including a first longitudinal axis;

an accessory compartment defined by the front wall and the rear wall, the accessory compartment including a first side, a second side, an upper portion and a lower portion;

an accessory compartment closing member positioned adjacent to the upper portion and extending from the first side to the second side of the accessory compartment;

a racquet panel coupled to the front wall and including a second longitudinal axis extending substantially parallel to the first longitudinal axis, the racquet panel including an arcuate first side edge, an arcuate second side edge, an arcuate lower edge coupled to the first and second side edges, and a upper edge positioned above the lower edge and coupled to the first and second side edges, the upper edge defining an upper opening between the racquet panel and the front wall;

a racquet compartment defined by the front wall and the racquet panel, the racquet compartment having a generally truncated egg-shaped cross-section defined by the first and second side edges, the lower edge, and the upper edge of the racquet panel, the racquet compartment further including an opening at the upper edge between the racquet panel and the front wall and conforming to the shape of a racquet head;

a carrying strap extending from the upper portion of the accessory compartment to the lower portion of the accessory compartment;

the accessory compartment including an upper center portion, a first lower corner portion laterally offset from the center upper portion, and a second lower corner portion laterally offset from the center upper portion;

the carrying strap including an upper end and a lower end, the upper end being coupled to the upper center portion of the accessory compartment proximate the first longitudinal center axis;

a releasable fastening member coupled to the lower end of the strap;

a first mating fastening member coupled proximate the first lower corner portion of the accessory compartment and laterally offset from the first longitudinal center axis;

a second mating fastening member coupled proximate the second lower corner portion of the accessory compartment, the second mating fastening member being positioned in spaced relation to the first mating fastening member and laterally offset from the first longitudinal center axis; and wherein the releasable fastening member is configured to be selectively coupled to one of the first and second mating fastening members.

16. The tennis bag of claim 15, further comprising a center partition received within the racquet compartment and defining a first racquet pocket and a second racquet pocket in spaced relation to the first racquet pocket.

17. The tennis bag of claim 16, wherein:

the first racquet pocket includes a side opening in one of the first and second sides of the racquet compartment, and a top opening in the top of the racquet compartment; and the second racquet pocket includes a side opening in one of the first and second sides of the racquet compartment, and a top opening in the top of the racquet compartment.

18. The tennis bag of claim 17, further comprising:

a first racquet pocket closing member coupled to the racquet panel and configured to selectively close the side opening of the first racquet pocket; and a second racquet pocket closing member coupled to the racquet panel and configured to selectively close the side opening of the second racquet pocket.

19. The tennis bag of claim 17, wherein the accessory compartment closing member comprises a zipper extending from a first end upwardly within the second side wall around the upper portion of the accessory compartment to a second end within the first side wall.

20. A tennis bag comprising:

a front wall;

a rear wall positioned in spaced relation to the front wall and defining a longitudinal center axis;

opposing first and second side walls connecting the front wall and the rear wall, the first and second side walls meeting at an apex;

a bottom wall coupled to the first and second side walls, the front wall, and the rear wall;

an accessory compartment defined by the front wall and the rear wall, the accessory compartment including an upper center portion, a first lower corner portion laterally offset from the center upper portion, and a second lower corner portion laterally offset from the upper center portion;

an accessory compartment closing member configured to close an opening to the accessory compartment between the front wall and the rear wall, the accessory compartment extending from a first end proximate the bottom wall upwardly within the second side wall around the apex to a second end within the first side wall;

a racquet panel coupled to the front wall;

a racquet compartment defined by the front wall and the racquet panel;

a carrying strap having an upper end and a lower end, the upper end being coupled to the upper center portion of the accessory compartment proximate the longitudinal center axis;

a releasable fastening member coupled to the lower end of the strap;

a first mating fastening member coupled proximate the first lower corner portion of the accessory compartment and laterally offset from the longitudinal center axis;

a second mating fastening member coupled proximate the second lower corner portion of the accessory compartment, the second mating fastening member positioned in spaced relation to the first mating fastening member and laterally offset from the longitudinal center axis;

the releasable fastening member being configured to be selectively coupled to one of the first and second mating fastening members;

a center partition received within the racquet compartment and defining first and second racquet pockets;

the first racquet pocket including a side opening in one of the first and second sides of the racquet compartment, and a top opening in the top of the racquet compartment;

the second racquet pocket including a side opening in one of the first and second sides of the racquet compartment, and a top opening in the top of the racquet compartment;

a first racquet pocket closing member coupled to the racquet panel and configured to selectively close the side opening of the first racquet pocket;

a second racquet pocket closing member coupled to the racquet panel and configured to selectively close the side opening of the second racquet pocket;

a ball storage pocket received within the accessory compartment and coupled to one of the rear wall and the front wall, the ball storage compartment configured to receive a canister of tennis balls and being angled upwardly from horizontal;

a cooler compartment coupled to one of the accessory compartment and the racquet compartment;

a pocket coupled to the rear wall;

a connector having a first end and a second end, the first end coupled within the pocket; and a fence hook coupled to the second end of the connector.

* * * * *